US010904993B2

(12) United States Patent
Rafac et al.

(10) Patent No.: US 10,904,993 B2
(45) Date of Patent: Jan. 26, 2021

(54) REDUCING THE EFFECT OF PLASMA ON AN OBJECT IN AN EXTREME ULTRAVIOLET LIGHT SOURCE

(71) Applicant: ASML Netherlands B.V., Veldhoven (NL)

(72) Inventors: Robert Jay Rafac, Encinitas, CA (US); John Tom Stewart, Escondido, CA (US); Andrew David LaForge, San Diego, CA (US)

(73) Assignee: ASML Netherlands B.V., Veldhoven (NL)

( * ) Notice: Subject to any disclaimer, the term of this patent is extended or adjusted under 35 U.S.C. 154(b) by 0 days.

(21) Appl. No.: 16/418,652

(22) Filed: May 21, 2019

(65) Prior Publication Data

US 2019/0274210 A1 Sep. 5, 2019

Related U.S. Application Data

(63) Continuation of application No. 16/057,101, filed on Aug. 7, 2018, now Pat. No. 10,349,509, which is a (Continued)

(51) Int. Cl.
*H05G 2/00* (2006.01)

(52) U.S. Cl.
CPC ..... *H05G 2/008* (2013.01); *H05G 2/005* (2013.01); *H05G 2/006* (2013.01)

(58) Field of Classification Search
USPC ..... 250/504 R
See application file for complete search history.

(56) References Cited

U.S. PATENT DOCUMENTS 6,927,405 B1 8/2005 Bonnet et al.
6,973,164 B2 12/2005 Hartlove et al.
(Continued)

FOREIGN PATENT DOCUMENTS

WO 2013029906 A1 3/2013
WO 2013174620 A1 11/2013

OTHER PUBLICATIONS

Junichi Fujimoto et al., "Development of Laser-Produced Tin Plasma-Based EUV Light Source Technology for HVM EUV Lithography," Physics Research International, vol. 2012, Article ID-249495, 2012, 8 pages.
(Continued)

*Primary Examiner* — Phillip A Johnston
(74) *Attorney, Agent, or Firm* — DiBerardino McGovern IP Group LLC

(57) ABSTRACT

A first target is provided to an interior of a vacuum chamber, a first light beam is directed toward the first target to form a first plasma from target material of the first target, the first plasma being associated with a directional flux of particles and radiation emitted from the first target along a first emission direction, the first emission direction being determined by a position of the first target; a second target is provided to the interior of the vacuum chamber; and a second light beam is directed toward the second target to form a second plasma from target material of the second target, the second plasma being associated with a directional flux of particles and radiation emitted from the second target along a second emission direction, the second emission direction being determined by a position of the second target, the first and second emission directions being different.

20 Claims, 25 Drawing Sheets

Related U.S. Application Data continuation of application No. 15/137,933, filed on Apr. 25, 2016, now abandoned.

(56) References Cited

U.S. PATENT DOCUMENTS

| | | | | |
|---|---|---|---|---|
| 7,239,686 | B2 | 7/2007 | Berglund et al. | |
| 7,372,056 | B2 * | 5/2008 | Bykanov | H05G 2/001 250/495.1 |
| 7,491,954 | B2 | 2/2009 | Bykanov et al. | |
| 7,671,349 | B2 | 3/2010 | Bykanov et al. | |
| 7,916,388 | B2 | 3/2011 | Bykanov | |
| 7,923,705 | B2 | 4/2011 | Moriya et al. | |
| 8,003,962 | B2 * | 8/2011 | Someya | H05G 2/003 250/504 R |
| 8,242,472 | B2 | 8/2012 | Moriya et al. | |
| 8,866,110 | B2 * | 10/2014 | Tao | H05G 2/003 250/504 R |
| 8,872,143 | B2 * | 10/2014 | Rafac | G03F 7/70033 250/504 R |
| 8,895,946 | B2 * | 11/2014 | Ceglio | H05G 2/008 250/504 R |
| 9,000,405 | B2 | 4/2015 | Fleurov et al. | |
| 9,130,345 | B2 * | 9/2015 | Yanagida | H01S 3/08054 |
| 9,462,668 | B2 * | 10/2016 | Tao | H01S 3/10 |
| 9,625,824 | B2 | 4/2017 | Lu et al. | |
| 9,632,419 | B2 | 4/2017 | Van Schoot et al. | |
| 2004/0108473 | A1 | 6/2004 | Melnychuk et al. | |
| 2006/0255298 | A1 | 11/2006 | Bykanov et al. | |
| 2007/0007469 | A1 | 1/2007 | Murakami et al. | |
| 2009/0057567 | A1 | 3/2009 | Bykanov et al. | |
| 2010/0024980 | A1 | 2/2010 | Ershov et al. | |
| 2010/0051831 | A1 | 3/2010 | Tao et al. | |
| 2010/0085547 | A1 | 4/2010 | Labetski et al. | |
| 2010/0181503 | A1 | 7/2010 | Yanagida et al. | |
| 2010/0193710 | A1 | 8/2010 | Wakabayashi et al. | |
| 2011/0057126 | A1 | 3/2011 | Hoshino et al. | |
| 2011/0079736 | A1 | 4/2011 | Hansson et al. | |
| 2011/0317256 | A1 | 12/2011 | Hou et al. | |
| 2012/0092746 | A1 | 4/2012 | Hou et al. | |
| 2012/0228525 | A1 | 9/2012 | Moriya et al. | |
| 2012/0235066 | A1 | 9/2012 | Ershov | |
| 2012/0305811 | A1 | 12/2012 | Wakabayashi et al. | |
| 2012/0307851 | A1 | 12/2012 | Hori et al. | |
| 2013/0027681 | A1 | 1/2013 | Mann et al. | |
| 2014/0264087 | A1 | 9/2014 | Rafac et al. | |
| 2015/0208494 | A1 | 7/2015 | Rafac et al. | |
| 2017/0311429 | A1 | 10/2017 | Rafac et al. | |
| 2018/0343730 | A1 | 11/2018 | Rafac et al. | |

OTHER PUBLICATIONS

C. Garban-Labaune et al., "Resonance Absorption in CO2 Laser-Plane Targets Interaction Experiments," Journal De Physique-Lettres, vol. 41, No. 19, Oct. 1980, pp. 463-467.

Jon T. Larsen, "Absorption and Profile Modification on Spherical Targets for. 25 < λ< 2 Microns," Lawrence Livermore Laboratory, Presentation at the 8th Annual Conference on Anomalous Absorption of Electromagnetic Waves, Tucson, Arizona, Apr. 4, 1978, 48 pages.

Masaki Nakano et al., "Sn Droplet Target Development for Laser Produced Plasma EUV Light Source," Emerging Lithographic Technologies XII., Edited by Schellenberg, Frank M., Proceedings of the SPIE, vol. 6921, Article ID. 692130, 2008, 8 pages.

Ahmed Hassanein et al.,"Combined Effects of Prepulsing and Target Geometry on Efficient Extreme Ultraviolet Production from Laser Produced Plasma Experiments and Modelling," Journal of Micro/Nanolithography, MEMS, and MOEMS, vol. 10, No. 3, Jul.-Sep. 2011, 7 pages.

Hakaru Mizoguchi et al., "Update of One Hundred watt HVM LPP-EUV Source performance," Oct. 5-7, 2015, EUVL Symposium, Maastricht, Netherland, International Symposium on Extreme Ultraviolet Lithography, 45 pages.

Blaine R. Copenheaver, U.S. International Searching Authority, International Search Report and Written Opinion, counterpart PCT Application No. PCT/US2017/025975, dated Aug. 23, 2017, 14 pages total.

* cited by examiner

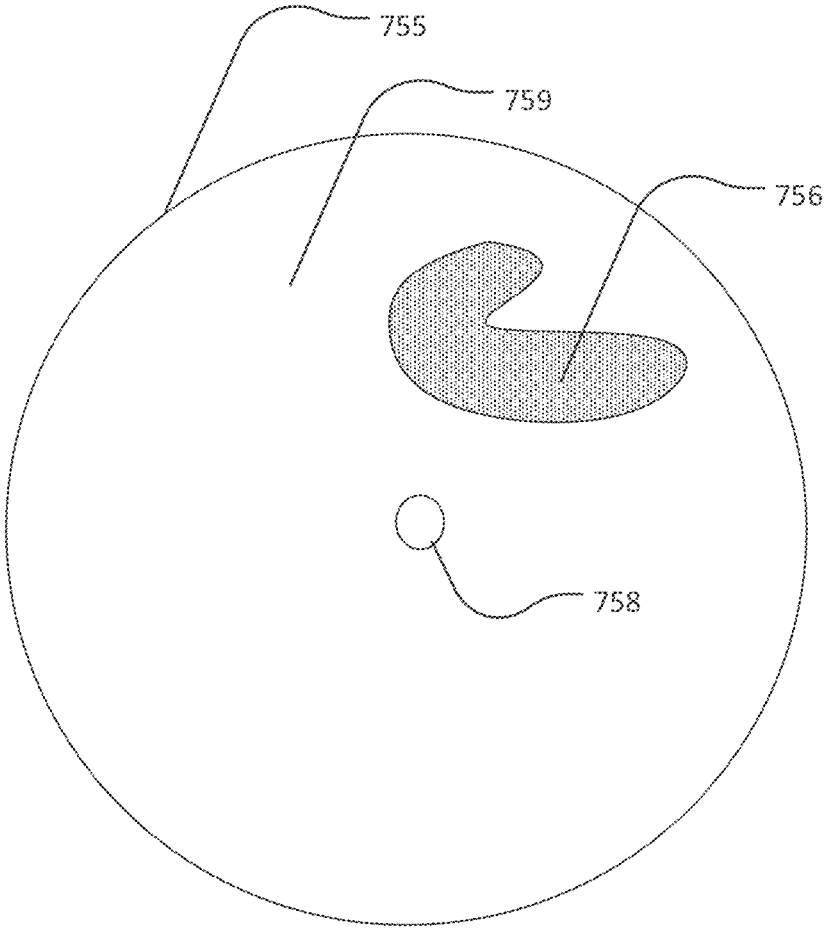
FIG. 7C
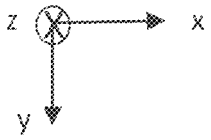

t=t1 t=t2 t=t3

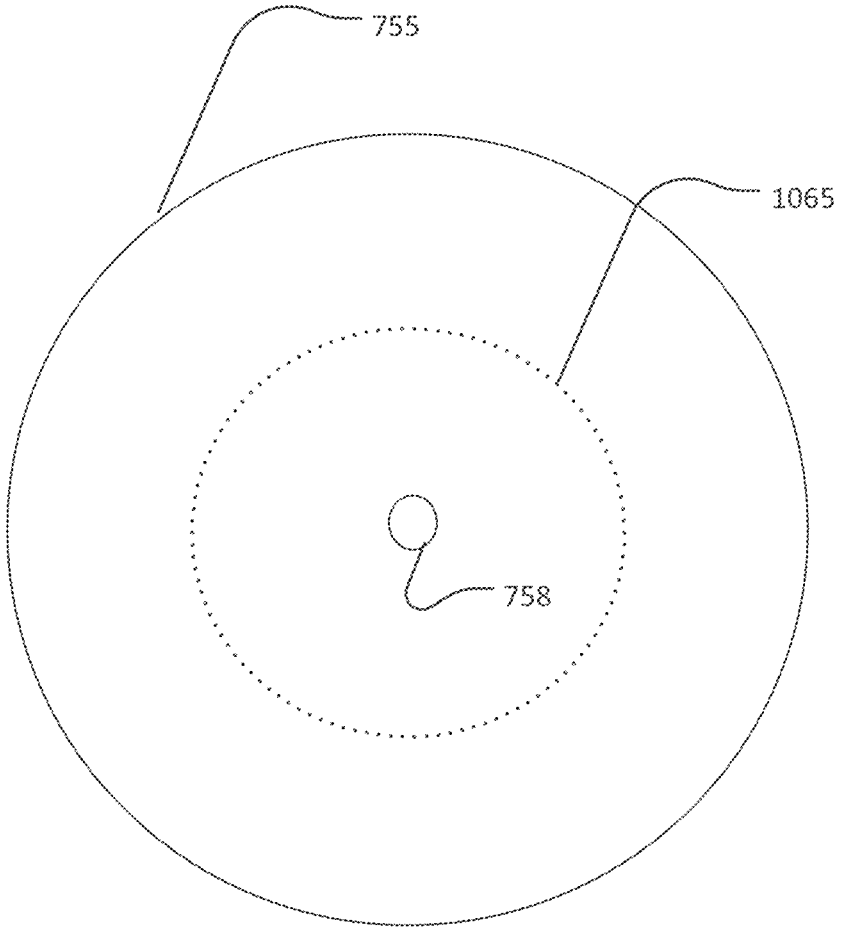
FIG. 10C
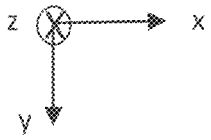

REDUCING THE EFFECT OF PLASMA ON AN OBJECT IN AN EXTREME ULTRAVIOLET LIGHT SOURCE

CROSS-REFERENCE TO RELATED APPLICATIONS

This application is a continuation of U.S. patent application Ser. No. 16/057,101, filed Aug. 7, 2018 (now allowed) and titled REDUCING THE EFFECT OF PLASMA ON AN OBJECT IN AN EXTREME ULTRAVIOLET LIGHT SOURCE, which is a continuation of U.S. patent application Ser. No. 15/137,933, filed Apr. 25, 2016 (now abandoned) and titled REDUCING THE EFFECT OF PLASMA ON AN OBJECT IN AN EXTREME ULTRAVIOLET LIGHT SOURCE, both of which are incorporated herein by reference in their entirety.

TECHNICAL FIELD

This disclosure relates to reducing the effect of plasma on an object in an extreme ultraviolet (EUV) light source.

BACKGROUND

Extreme ultraviolet ("EUV") light, for example, electromagnetic radiation having wavelengths of around 50 nm or less (also sometimes referred to as soft x-rays), and including light at a wavelength of about 13 nm, may be used in photolithography processes to produce extremely small features in substrates, for example, silicon wafers.

Methods to produce EUV light include, but are not necessarily limited to, converting a material that has an element, for example, xenon, lithium, or tin, with an emission line in the EUV range in a plasma state. In one such method, often termed laser produced plasma ("LPP"), the required plasma may be produced by irradiating a target material, for example, in the form of a droplet, plate, tape, stream, or cluster of material, with a light beam that may be referred to as a drive laser. For this process, the plasma is typically produced in a sealed vessel, for example, a vacuum chamber, and monitored using various types of metrology equipment.

SUMMARY

In one general aspect, a first target is provided to an interior of a vacuum chamber, the first target including target material that emits extreme ultraviolet (EUV) light in a plasma state; a first light beam is directed toward the first target to form a first plasma from the target material of the first target, the first plasma being associated with a directional flux of particles and radiation emitted from the first target along a first emission direction, the first emission direction being determined by a position of the first target; a second target is provided to the interior of the vacuum chamber, the second target including target material that emits extreme ultraviolet light in a plasma state; and a second light beam is directed toward the second target to form a second plasma from the target material of the second target, the second plasma being associated with a directional flux of particles and radiation emitted from the second target along a second emission direction, the second emission direction being determined by a position of the second target, the second emission direction being different from the first emission direction.

Implementations may include one or more of the following features. The target material of the first target may be arranged in a first geometric distribution, the first geometric distribution may have an extent along an axis oriented at a first angle relative to a separate and distinct object in the vacuum chamber, the target material of the second target may be arranged in a second geometric distribution, the second geometric distribution may have an extent along an axis oriented at a second angle relative to the separate and distinct object in the vacuum chamber, the second angle may be different from the first angle, the first emission direction may be determined by the first angle, and the second emission may be determined by the second angle.

In some implementations, providing a first target to an interior of a vacuum chamber includes: providing a first initial target to the interior of the vacuum chamber, the first initial target including target material in an initial geometric distribution; and directing an optical pulse toward the first initial target to form the first target, the geometric distribution of the first target being different from the geometric distribution of the first initial target, and providing a second target to an interior of a vacuum chamber includes: providing a second initial target to the interior of the vacuum chamber, the second initial target including target material in a second initial geometric distribution; and directing an optical pulse toward the second initial target to form the second target, the geometric distribution of the second target being different from the geometric distribution of the second initial target.

The first initial target and the second initial target may be substantially spherical, and the first target and the second target may be disk shaped. The first initial target and the second initial target may be two initial targets of a plurality of initial targets that travel along a trajectory, and the separate and distinct object in the vacuum chamber may be one of the plurality of initial targets other than the first initial target and the second initial target.

A fluid may be provided to the interior of the vacuum chamber, the fluid occupying a volume in the vacuum chamber, and the separate and distinct object in the vacuum chamber may include a portion of the fluid. The fluid may be a flowing gas. In a target region that receives the target, the first light beam may propagate toward the first target and the second light beam may propagate toward the second target in a propagation direction, and the flowing gas may flow in a direction that is parallel to the propagation direction.

The separate and distinct object in the vacuum chamber may include an optical element. The optical element may be a reflective element.

The separate and distinct object in the vacuum chamber may be a portion of a reflective surface of an optical element, and the portion being less than all of the reflective surface.

A fluid may be provided to the interior of the vacuum chamber based on a flow configuration, and, in these implementations, the fluid flows in the vacuum chamber based on the flow configuration. The first light beam and the second light beam may be optical pulses in a pulsed light beam configured to provide an EUV burst duration, and the EUV burst duration may be determined. A property of the fluid associated with the EUV burst duration may be determined, the property including one or more of a minimum flow rate, density, and pressure of the fluid, and the flow configuration of the fluid may be adjusted based on the determined property. The flow configuration may include one or more of a flow rate and a flow direction of the fluid, and adjusting the flow configuration of the fluid may include adjusting one or more of the flow rate and the flow direction.

In some implementations, the first target forms a plasma at a first time, the second plasma forms a target at a second time, the time between the first time and the second time being an elapsed time, and the light beam includes a pulsed light beam configured to provide an EUV burst duration. The EUV burst duration may be determined, a minimum flow rate associated with the EUV burst duration may be determined, and one or more of the elapsed time and the flow rate of the fluid may be adjusted based on the determined minimum flow rate of the fluid.

The first light beam may have an axis, and the intensity of the first light beam may be greatest at the axis. The second light beam may have an axis, and the intensity of the second light beam may greatest at the axis of the second light beam. The first emission direction may be determined by a location of the first target relative to the axis of the first light beam, and the second emission direction may be determined by a location of the second target relative to the axis of the second beam.

The axis of the first light beam and the axis of the second light beam may be along the same direction, the first target is at a location on a first side of the axis of the first light beam, and the second target is at a location on a second side of the axis of the first light beam.

The axis of the first light beam and the axis of the second light beam may be along different directions, and the first target and the second target may be at substantially the same location in the vacuum chamber at different times.

The first and second targets may be substantially spherical.

In another general aspect, the effect of plasma on an object in a vacuum chamber of an extreme ultraviolet (EUV) light source may be reduced. An initial target is modified, in the vacuum chamber, to form a modified target, the initial target including target material in an initial geometric distribution and the modified target including target material in a different, modified geometric distribution. A light beam is directed toward the modified target, the light beam having an energy sufficient to convert at least some of the target material in the modified target to plasma that emits EUV light, the plasma being associated with a directionally dependent flux of particles and radiation, the directionally dependent flux having an angular distribution relative to the modified target, the angular distribution being dependent on a position of the modified target such that positioning the modified target in the vacuum chamber reduces the effect of the plasma on the object.

Implementations may include one or more of the following features. The modified geometric distribution may have a first extent in a first direction and a second extent in a second direction, the second extent may be larger than the first extent, and the modified target may be positioned by orienting the second extent at an angle relative to the object. A second initial target also may be provided to an interior of the vacuum chamber, the initial target and the second initial target traveling along a trajectory. The separate and distinct object may be the second initial target. The second initial target may be one target in a stream of targets that travel on the trajectory. The second initial target may be the target in the stream that is closest in distance to the initial target. In some implementations, the second initial target is modified to form a second modified target, the second modified target having the modified geometric distribution of target material, and the second extent of the second modified target being positioned with the second extent oriented at a second, different angle relative to the separate and distinct object. The separate and distinct object may be one of more of a portion of a volume of fluid that flows in the vacuum chamber and an optical element in the vacuum chamber.

The modified target may be positioned by directing a pulse of light at the initial target away from a center of the initial target such that the target material of the initial target expands along the second extent and reduces along the first extent, and the second extent tilts relative to the separate and distinct object.

A fluid may be provided to the interior of the vacuum chamber, the fluid occupying a volume in the vacuum chamber, and the separate and distinct object in the vacuum chamber may include a portion of the volume of the fluid.

In another general aspect, a control system for an extreme ultraviolet (EUV) light source includes one or more electronic processors; an electronic storage storing instructions that, when executed, cause the one or more electronic processors to: declare a presence of a first initial target at a first time, the first initial target having a distribution of target material that emits EUV light in a plasma state; direct a first light beam toward the first initial target at a second time based on the declared presence of the first initial target, a difference between the first time and the second time being a first elapsed time; declare a presence of a second initial target at a third time, the third time occurring after the first time, the second initial target including target material that emits EUV light in a plasma state; direct the first light beam toward the second initial target at a fourth time based on the declared presence of the second initial target, the fourth time occurring after the second time, a difference between the third time and the fourth time being a second elapsed time, where the first elapsed time is different from the second elapsed time such that the first and second initial targets expand along different directions and have different orientations in a target region, the target region being a region that receives a second light beam having energy sufficient to convert target material to plasma that emits EUV light.

Implementations of any of the techniques described above may include an apparatus, a method or process, an EUV light source, an optical lithography system, a control system for an optical source, or instructions stored on a computer-readable medium.

The details of one or more implementations are set forth in the accompanying drawings and the description below. Other features will be apparent from the description and drawings, and from the claims.

BRIEF DESCRIPTION OF THE DRAWINGS

FIG. 7C is a block diagram of an exemplary optical element in the vacuum chamber of FIGS. 7A and 7B.

FIG. 10C is a block diagram of an optical element and a path swept out by a peak of a directionally dependent energy profile.

DETAILED DESCRIPTION

Techniques for reducing the effect of plasma on objects in a vacuum chamber of an extreme ultraviolet (EUV) light source are disclosed. To produce EUV light, the EUV light source converts target material in targets to plasma that emits EUV light. By varying a spatial orientation or position of the various targets such that the targets do not all have the same position or orientation, the effect of the plasma may be reduced. The described techniques may be used to, for example, protect objects inside of a vacuum vessel of an EUV light source.

Figure 1:
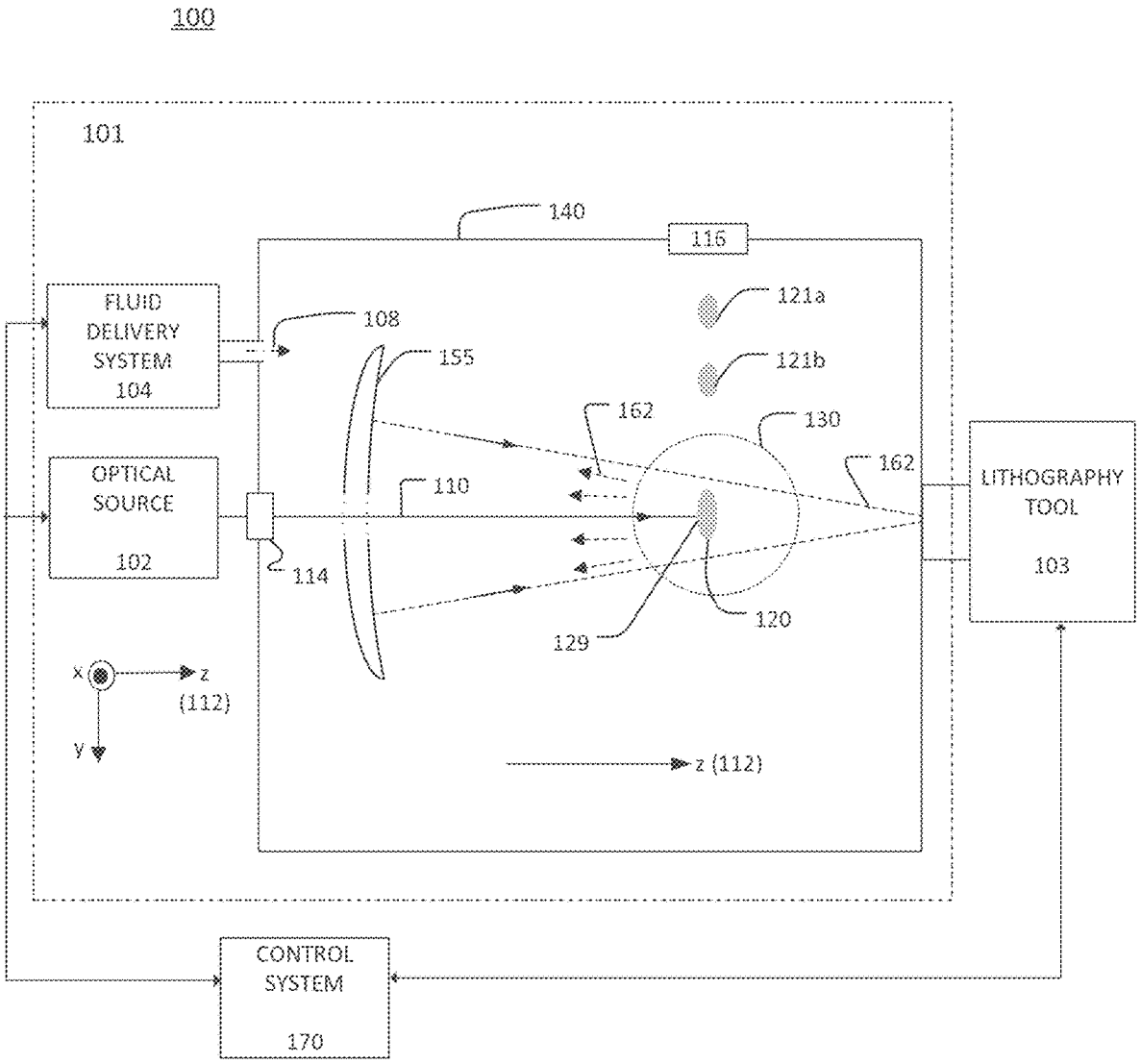
FIG. 1 is a block diagram of an exemplary optical lithography system that includes an EUV light source.

Referring to FIG. 1, a block diagram of an exemplary optical lithography system 100 is shown. The system 100 includes an extreme ultraviolet (EUV) light source 101 that provides EUV light 162 to a lithography tool 103. The EUV light source 101 includes an optical source 102 and a fluid delivery system 104. The optical source 102 emits a light beam 110, which enters a vacuum vessel 140 through an optically transparent opening 114 and propagates in a direction z (112) at a target region 130, which receives a target 120. The light beam 110 can be an amplified light beam.

The fluid delivery system 104 delivers a buffer fluid 108 into the vessel 140. The buffer fluid 108 may flow between an optical element 155 and the target region 130. The buffer fluid 108 may flow in the direction z or in any other direction, and the buffer fluid 108 may flow in multiple directions. The target region 130 receives the target 120 from a target supply system 116. The target 120 includes a target material that emits EUV light 162 when in a plasma state, and an interaction between the target material and the light beam 110 at the target region 130 converts at least some of the target material to plasma. The optical element 155 directs EUV light 162 toward the lithography tool 103. A control system 170 can receive and provide electronic signals to the fluid delivery system 104, the optical source 102, and/or the lithography tool 103 to allow for control of any or all of these components. An example of the control system 170 is discussed below with respect to FIG. 4.

The target material of the target 120 is arranged in a geometric or spatial distribution, with a side or region 129 that receives (and interacts with) the light beam 110. As discussed above, the target material emits EUV light 162 when in a plasma state. Additionally, the plasma also emits particles (such as ions, neutral atoms, and/or clusters of the target material) and/or radiation other than EUV light. The energy emitted by the plasma (including the particles and/or radiation that is other than EUV light) is non-isotropic relative to the geometric distribution of the target material. The energy emitted by the plasma may be considered to be a directionally dependent flux of energy with an angularly dependent distribution relative to the target 120. Thus, the plasma may direct a greater amount of energy toward some regions in the vessel 140 than others. The energy emitted from the plasma causes, for example, localized heating in the regions toward which it is directed.

FIG. 1 shows the vacuum vessel 140 at an instance of time. In the example shown, the target 120 is in the target location 130. At times before and/or after the time of FIG. 1, other instances of the target 120 are in the target region 130. As discussed below, the other instances of the target 120 are similar to the target 120 except, as compared to the target 120, prior and/or subsequent instances of the target 120 have a different geometric distribution of target material, a different position in the vacuum vessel 140, and/or a different orientation of the geometric distribution of target material relative to an object or objects in the vacuum vessel 140. In other words, the geometric distribution, position, and/or orientation of a target that is present in the target region 130 varies among the instances and can be considered to vary over time. In this way, the direction along which the peak (maximum) of the directionally dependent flux extends may be changed over time. Thus, the peak of the directionally dependent flux may be directed away from a particular object, a particular portion of an object, and/or a region of the vessel 140, thereby reducing the effects of the plasma on that object, portion, or region.

Varying the position, geometric distribution, and/or orientation of the target material among the instances or over time increases the total amount of area toward which energy is directed by the plasma. Thus, varying the position of the target and/or the target orientation over time allows the energy from the plasma to more closely approximate an isotropic energy profile relative to the target 120 such that a particular region in the vessel 140 is not exposed (for example, heated) excessively compared to other regions. This allows an object or objects in the vicinity of the target region 130, such as optical elements in the vessel 140 (for example, the optical element 155), and other objects in the vessel 140, such as targets other than the target 120 (for example, subsequent or previous targets, such as targets 121*a*, 121*b*), and/or the buffer fluid 108, to be protected from the plasma. Protecting objects from the plasma may increase the useful life of the object, and/or make the light source 101 perform more efficiently and/or reliably.

FIGS. 2A-2D discuss an example target that may be used as the target 120 to produce the plasma that emits EUV light 162. FIGS. 3A-3C, 3E, and 3F discuss examples of a directional flux that may be associated with the plasma.

Figure 2A:
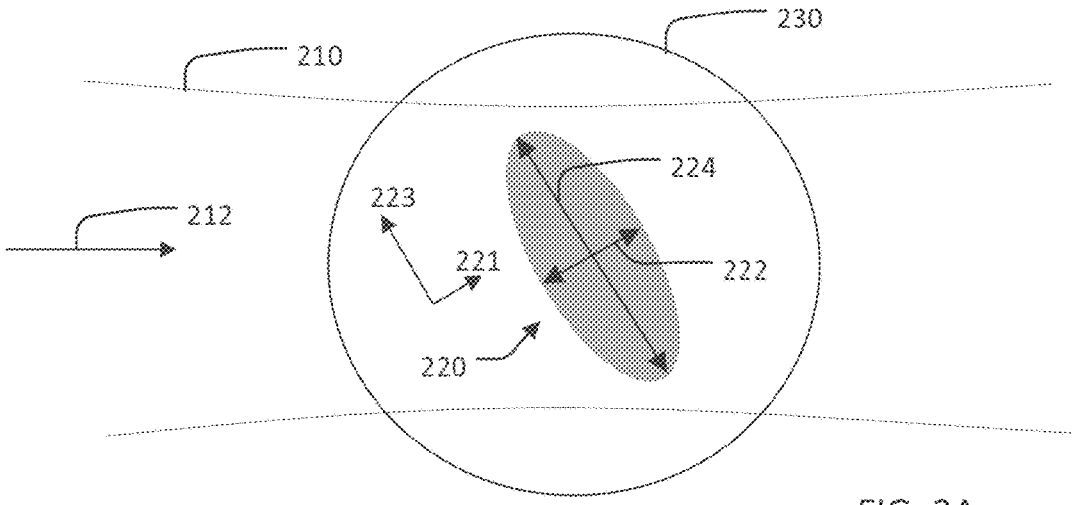
FIG. 2A is a side cross-sectional view of an exemplary target.

Referring to FIG. 2A, a side cross-sectional view (viewed along the direction x) of an exemplary target 220 is shown. The target 220 may be used in the system 100 as the target 120. The target 220 is inside of a target region 230 that receives a light beam 210. The target 220 includes a target material (such as, for example, tin, lithium, and/or xenon) that emits EUV light when converted to plasma. The light beam 210 has energy sufficient to convert at least a portion of the target material in the target 220 to plasma.

The exemplary target 220 is an ellipsoid (a three-dimensional ellipse). In other words, the target 220 occupies a volume that is approximately defined as the interior of a surface that is a three-dimensional analog of an ellipse. However, the target 220 may have other forms. For example, the target 220 may occupy a volume that has the shape of all or part of a sphere, or the target 220 may occupy an arbitrarily shaped volume, such as a cloud-like form that does not have well-defined edges. For a target 220 that lacks well-defined edges, a volume that contains, for example, 90%, 95%, or more of the target material may be treated as the target 220. The target 220 may be asymmetric or symmetric.

Additionally, the target 220 may have any spatial distribution of target material and may include non-target material (material that does not emit EUV light in a plasma state). The target 220 may be a system of particles and/or pieces, an extended object that is essentially a continuous and homogenous material, a collection of particles (including ions and/or electrons), a spatial distribution of material that includes continuous segments of molten metal, pre-plasma, and particles, and/or a segment of molten metal. The contents of the target 220 may have any spatial distribution. For example, the target 220 may be homogeneous in one or more directions. In some implementations, the contents of the target 220 are concentrated in a particular portion of the target 220 and the target 220 has a non-uniform distribution of mass.

The target material can be a target mixture that includes a target substance and impurities such as non-target particles. The target substance is the substance that, when in a plasma state, has an emission line in the EUV range. The target substance can be, for example, a droplet of liquid or molten metal, a portion of a liquid stream, solid particles or clusters, solid particles contained within liquid droplets, a foam of target material, or solid particles contained within a portion of a liquid stream. The target substance can be, for example, water, tin, lithium, xenon, or any material that, when converted to a plasma state, has an emission line in the EUV range. For example, the target substance can be the element tin, which can be used as pure tin (Sn); as a tin compound, for example, $SnBr_4$, $SnBr_2$, $SnH_4$; as a tin alloy, for example, tin-gallium alloys, tin-indium alloys, tin-indium-gallium alloys, or any combination of these alloys. Moreover, in the situation in which there are no impurities, the target material includes only the target substance.

The side cross-section of the target 220 shown in FIG. 2A is an ellipse with a major axis, which has a length equal to the largest distance that spans the entire ellipse, and a minor axis, which is perpendicular to the major axis. The target 220 has a first extent 222 that extends along a direction 221, and a second extent 224 that extends along a direction 223 that is perpendicular to the direction 221. For the exemplary target 220, the extent 222 and the direction 221 are the length and direction, respectively, of the minor axis, and the extent 224 and the direction 223 are the length and direction, respectively, of the major axis.

Figure 2C:
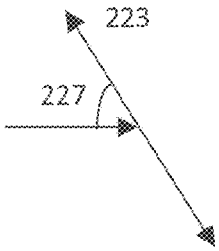
FIGS. 2C and 2D are illustrations of different exemplary positions of the target of FIG. 2A.
Figure 2D:
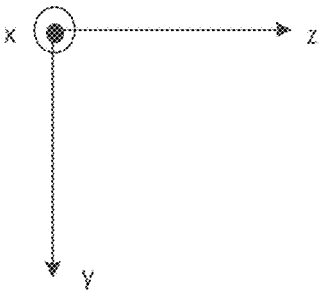
Figure 2D:
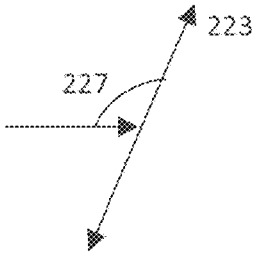
Figure 2B:
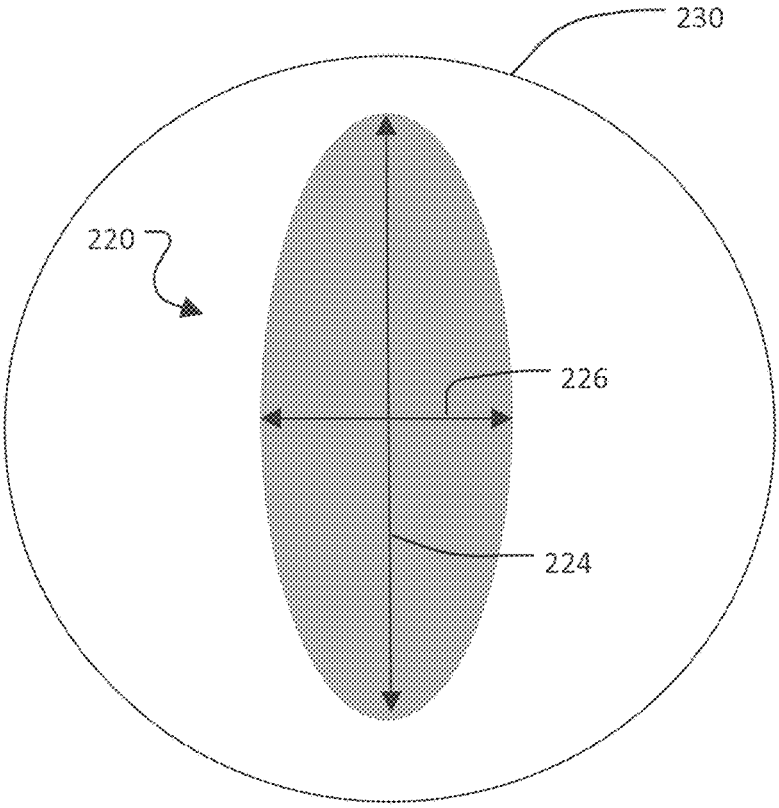
FIG. 2B is a front cross-sectional view of the target of FIG. 2A.
Figure 2B:
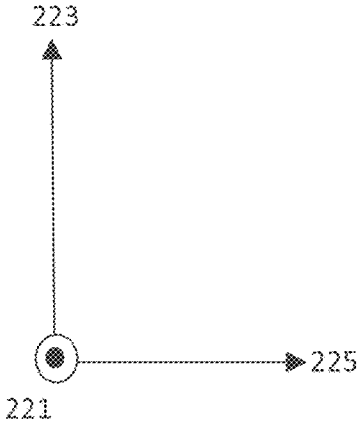

Referring also to FIG. 2B, a front cross-sectional view of the target 220, viewed along the direction 221, is shown. The target 220 has an elliptically shaped front cross-section with the major axis extending in the direction 223 and having the extent 224. The front cross-section of the target 220 has an extent 226 in a third dimension in a direction 225. The direction 225 is perpendicular to the directions 221 and 223.

Referring to FIG. 2A, the extent 224 of the target 220 is tilted relative to the direction 212 of propagation of the light beam 210. Referring also to FIG. 2C, the direction 223 of the extent 224 forms an angle 227 with the direction 212 of propagation of the light beam 210. The angle 227 is measured relative to the light beam 210 as it travels in the direction 212 and impinges on the target 220. The angle 227 may be 0-180 degrees. In FIGS. 2A and 2C, the target 220 is tilted with the direction 223 being less than 90 degrees relative to the direction 212. FIG. 2D shows an example in which the angle 227 is between 90 and 180 degrees.

As discussed above, the target 220 may have other forms besides an ellipsoid. For targets that occupy a volume, the shape of the target may be considered to be a three-dimensional form. The form may be described with the three extents 222, 224, 226, which extend along the three mutually orthogonal directions 221, 223, 225, respectively. The lengths of the extents 222, 224, 226 may be the longest length across the form, from one edge of the form to an edge on another side of the form, in a particular direction that corresponds to one of the directions 221, 223, 225. The extents 222, 224, 226 and their respective directions 221, 223, 225 may be determined or estimated from visual inspection of the target 220. For example, the target 220 may be used as the target 120 in the system 100. In these implementations, visual inspection of the target 220 may occur by, for example, imaging the target 220 as it leaves the target material supply apparatus 116 and travels to the target region 130 (FIG. 1).

In some implementations, the directions 221, 223, 225 may be considered to be mutually orthogonal axes that pass through the center of mass of the target 220 and correspond to the principal axes of inertia for the target 220. The center of mass of the target 220 is the point in space where the relative position of the mass of the target 220 is zero. In other words, the center of mass is the average position of the material that makes up the target 220. The center of mass does not necessary coincide with the geometric center of the target 220, but may when the target is a homogenous and symmetric volume.

The center of mass of the target 220 may be expressed as a function of products of inertia, which are a measure of imbalance of the spatial distribution of mass in the target 220. The products of inertia may be expressed as a matrix or a tensor. For a three-dimensional object, three mutually orthogonal axes that pass through the center of mass exist for which the products of inertia are zero. That is, the product of inertia lies along a direction in which the mass is equally balanced on either side of a vector that extends along that direction. The directions of the products of inertia may be referred to as the principal axes of inertia of the three-dimensional object. The directions 221, 223, 225 may be the principal axes of inertia for the target 220. In this implementation, the directions 221, 223, 225 are the eigenvectors of the inertial tensor or matrix of the products of inertia for the target 220. The extents 222, 224, 226 may be determined from the eigenvalues of the inertial tensor or matrix of the products of inertia.

In some implementations, the target 220 may be regarded as an approximately two-dimensional object. When the target 220 is two-dimensional, the target 220 may be modeled with two orthogonal principal axes and two extents along the directions of the principal axes. Alternatively or additionally, as for a three-dimensional target the extents and directions for a two-dimensional target may be determined through visual inspection.

The spatial distribution of energy emitted from a plasma formed from the target material of a target such as the target 220 depends on the positioning or orientation of the target and/or the spatial distribution of the target material in the target. The position of the target is the location, arrangement, and/or orientation of the target relative to an irradiating light beam and/or an object in the vicinity of the target. The orientation of the target may be considered to be the arrangement and/or angle of the target relative to an irradiating light beam and/or to an object in the vicinity of the target. The spatial distribution of the target is the geometric arrangement of the target material of the target.

Figure 3A:
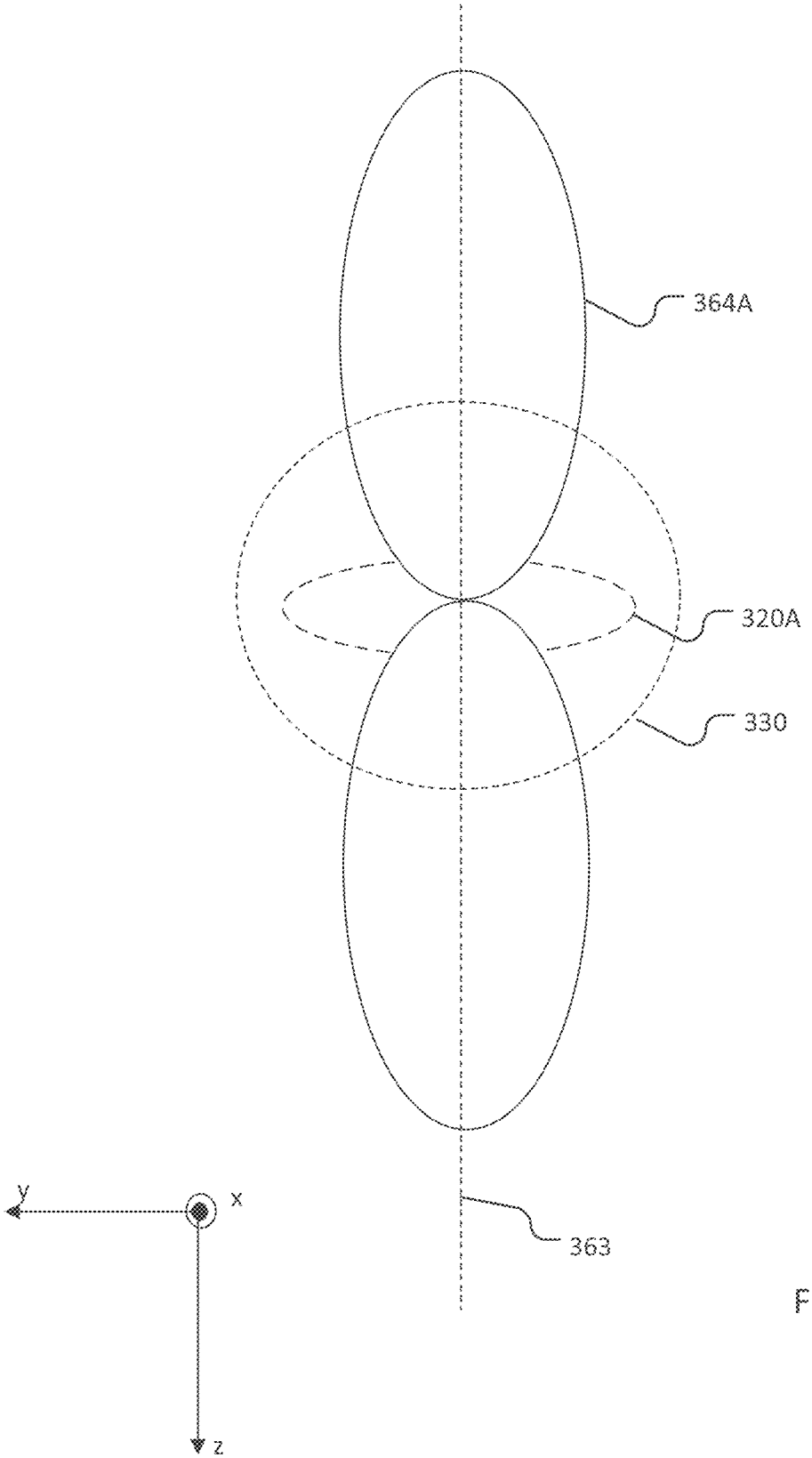
FIG. 3A is an illustration of energy emitted from plasma formed from an exemplary target.

Referring to FIG. 3A, an exemplary energy distribution 364A is shown. In the example of FIG. 3A, the solid line depicts the energy distribution 364A. The energy distribution 364A is the angular distribution of energy emitted from a plasma formed from the target material in a target 320A. The energy is emitted from the plasma has a peak or a maximum in a direction along an axis 363. The direction along which the axis 363 extends (and thus the direction in which the energy is primarily emitted) depends on the positioning of the target 320A and/or the spatial distribution of target material in the target 320A. The target 320A may be positioned such that an extent of the target in one direction forms an angle relative to a direction of propagation of a light beam. In another example, the target 320A may be positioned relative to the most intense portion of the light beam, or the target 320A positioned with an extent of the target at an angle relative to an object in a vacuum chamber. The energy distribution 364A is provided as an example, and other energy distributions may have different spatial characteristics. FIGS. 3B, 3C, 3E, and 3F show additional examples of spatial energy distributions.

Figure 3B:
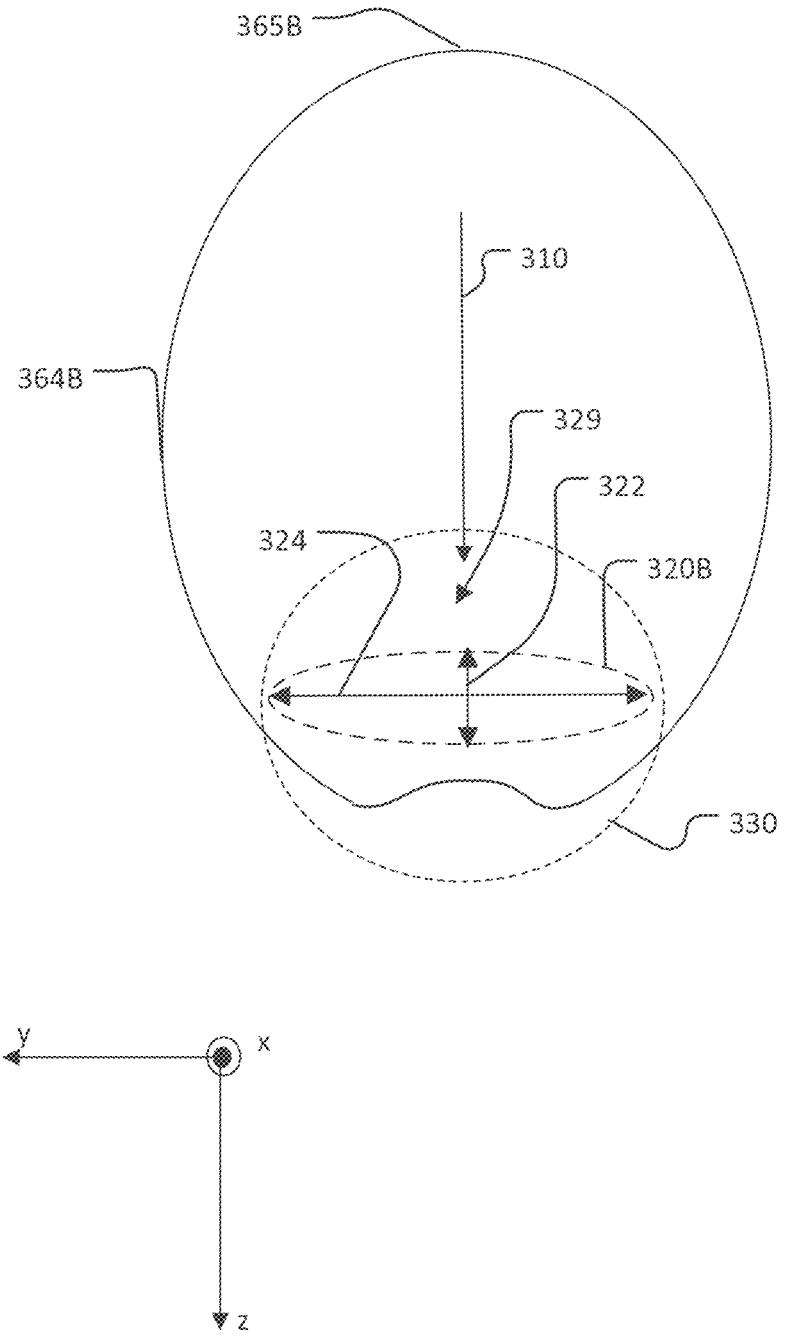
FIGS. 3B and 3C are block diagrams of an exemplary target in two different positions.
Figure 3C:
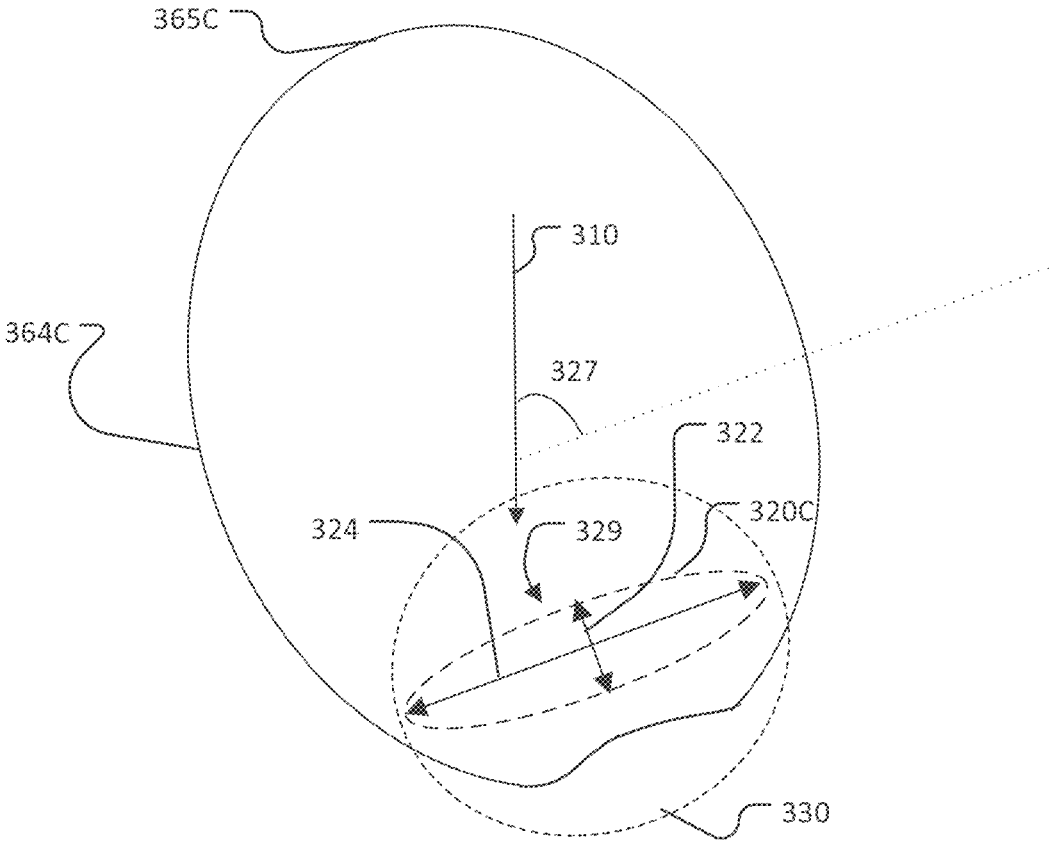
Figure 3C:
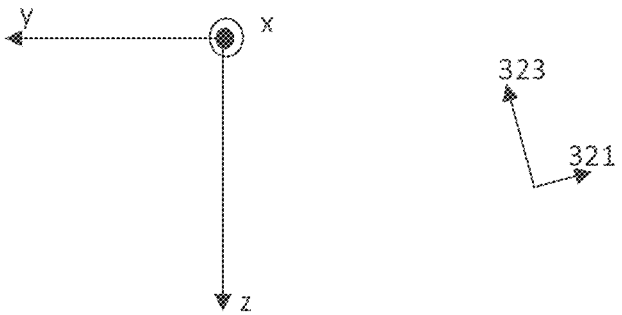

Referring to FIGS. 3B and 3C, respectively, exemplary energy distributions 364B and 364C with respective peaks (or maximums) 365B, 365C are shown. The energy distributions 364B, 364C represent a spatial distribution of energy emitted from a plasma formed by an interaction between a light beam 310, which propagates in the z direction at the target region 330, and target material in a target 320B, 320C, respectively. The interaction converts at least some of the target material in the target 320 to plasma. The spatial distributions of energy 364B and 364C may represent the angular spatial distribution of the average energy or the total energy emitted from the plasma.

The target material of the targets 320B, 320C is arranged in a disk-like shape, such as an ellipsoid (similar to the target 220 of FIGS. 2A and 2B) with an elliptical cross-section in the x-y plane. The target 320B has an extent 324 in the y direction, and an extent 322 in the z direction. The extent 324 is greater than the extent 322. In the example of FIG. 3B, the extent 322 is parallel to the direction of propagation of the light beam 310, and the target 320 is not tilted relative to the light beam 310. In the example of FIG. 3C, the target 320C is tilted relative to the direction of propagation of the light beam 310. For the target 320C, the extent 324 is along a direction 321, which is tilted at an angle 327 from the direction of propagation of the light beam 310. The extent 322 is along a direction 323. Thus, the example of FIGS. 3B and 3C shows targets that are positioned in two different ways, and the energy distributions 364B and 364C show how the peaks 365B, 365C can be moved by changing the target position.

The plasma formed by the interaction between the target material and the light beam 310 emits energy, including EUV light, particles, and radiation other than EUV light. The particles and radiation may include, for example, ions (charged particles) formed from the interaction between the light beam 310 and the target material. The ions may be ions of the target material. For example, when the target material is tin, the ions emitted from the plasma may be tin ions. The ions may include high-energy ions that travel a relatively long distance from the target 120, and relatively low-energy ions that travel a shorter distance from the target 120. The high-energy ions transfer their kinetic energy as heat into material that receives them and create localized regions of heat in the material. A high-energy ion may be an ion that has an energy equal to or greater than, for example, 500 electron volts (eV). A low-energy ion may be an ion that has an energy less than 500 eV.

As discussed above, the example distributions 364B and 364C of FIGS. 3B and 3C, respectively, may be considered to show the spatial distribution of the total or average energy of the ions that are emitted from the plasma. In the example of FIG. 3B, the energy caused by emission of the ions has the distribution 364B in the y-z plane. The distribution 364B represents the relative amount of energy emitted from the plasma as a function of angle relative to the center of the target 320B. In the example of FIG. 3B, the extent 324 is perpendicular to the direction of propagation of the light beam 310 at the target region 330, and the greatest amount of energy are delivered in the direction of the peak 365B. In the example of FIG. 3B, the peak 365B is in the −z direction, which is parallel to the extent 322 and perpendicular to the extent 324. The lowest amount of energy is emitted in the z direction, and it is possible that the low-energy ions are preferentially emitted in the z direction.

Relative to FIG. 3B, the position of the target 320C (FIG. 3C) is different. In the example of FIG. 3C, the extent 324 is tilted at the angle 327 relative to the direction of propagation of the beam 310. The profile 364B of the total or average ion energy is also different in the example of FIG. 3C, with the greatest amount of energy being emitted toward the peak 365C. As with the example of FIG. 3B, in the example of FIG. 3C, ions may be preferentially emitted along a direction that extends away from a side 329 of the target 320 that receives the light beam 310 and is normal to the extent 324. The side 329 is the portion or side of the target 320 that receives the light beam 310 before any other portion of the target 320 or the portion or side of the target 320C that receives the most radiation from the light beam 310. The side 329 is also referred to as the "heating side."

Other particles and radiation emitted from the plasma may have a different profile in the y-z plane. For example, a profile may represent the profile of high-energy ions or low-energy ions. The low-energy ions may be preferentially emitted in a direction that is opposite to the direction in which the high-energy ions are preferentially emitted.

The plasma created by the interaction of the targets 320B, 320C and the light beam 310 thus emits a directionally dependent flux of radiation and/or particles. The direction in which the highest portion of the radiation and/or particles is emitted depends on the position of the target 320B, 320C. By adjusting or changing the position or orientation of the target 320, the direction in which the greatest amount of radiation and/or particles is emitted is also changed, allowing the heating effects of the directionally dependent flux on other objects to be minimized or eliminated.

The spatial distribution of energy emitted from the plasma also may be changed by changing the relative position of the target and the light beam 310.

Figure 3D:
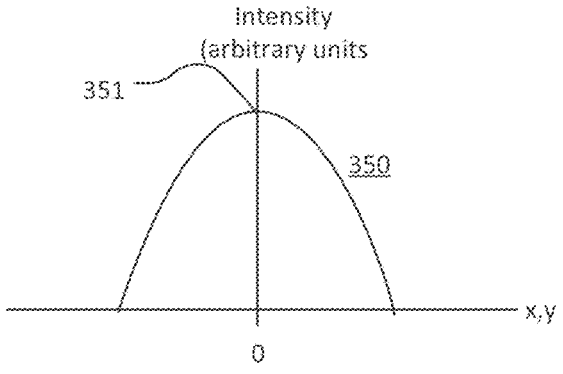
FIG. 3D is an example of an intensity profile of a light beam.

FIG. 3D shows an example intensity profile for the light beam 310. The intensity profile 350 represents the intensity of the light beam 310 as a function of position in the x-y plane, which is perpendicular to the direction of propagation at the target region 330 (the direction z). The intensity profile has a maximum 351 in the x-y plane along an axis 352. The intensity decreases on either side of the maximum 351.

Figure 3E:
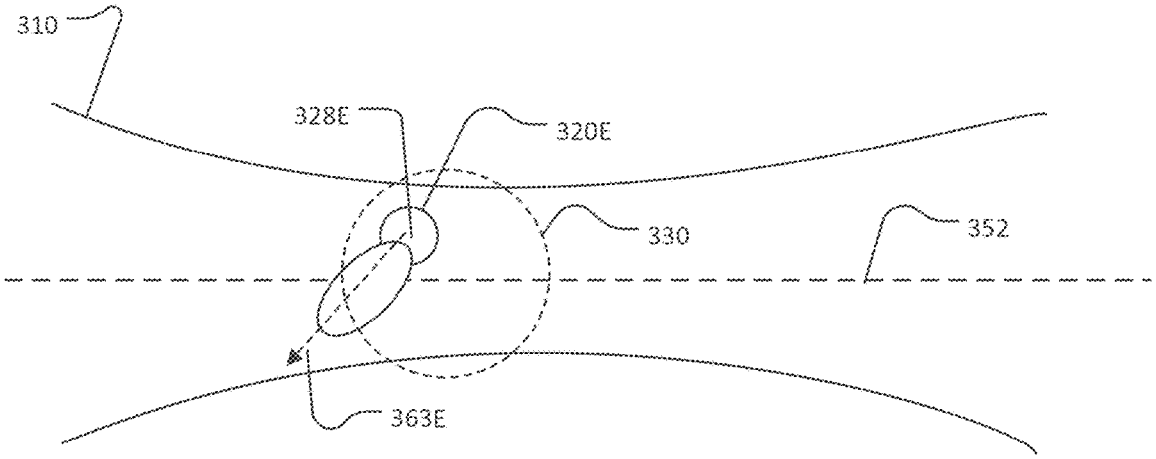
FIGS. 3E and 3F are block diagrams of a light beam interacting with an exemplary target in two different positions.
Figure 3F:
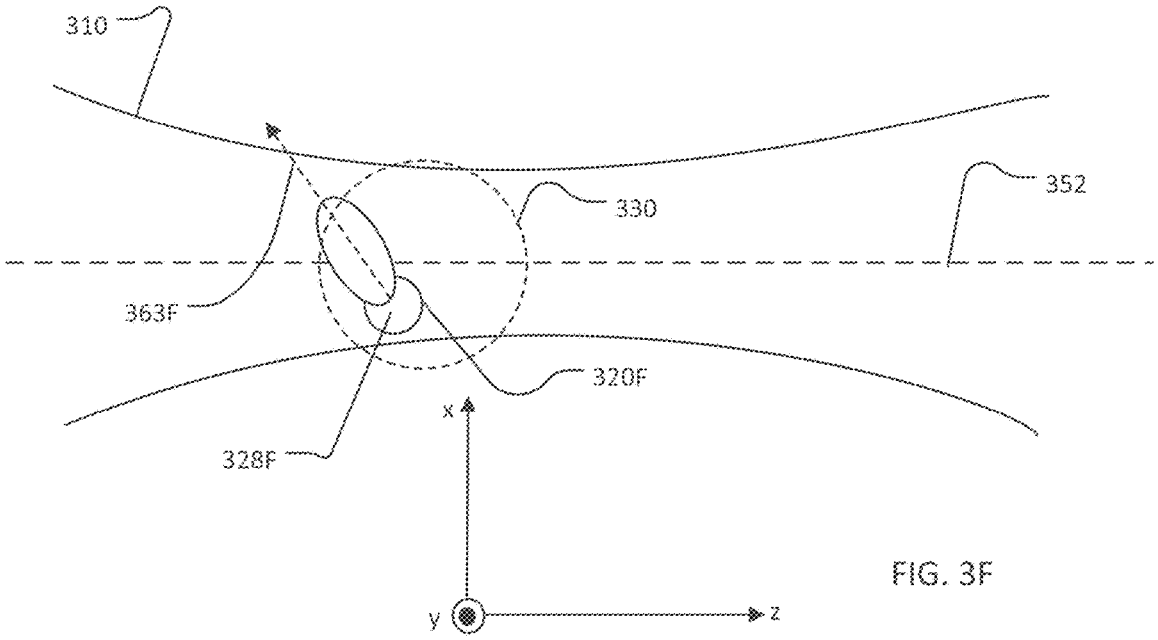

FIG. 3E and FIG. 3F show a target 320E and a target 320F, respectively, interacting with the light beam 310. The targets 320E and 320F are substantially spherical and contain target material that emits EUV light when in a plasma state. The target 320E (FIG. 3E) is at a location 328E, which is displaced from the axis 352 in the x direction. The target 320F (FIG. 3F) is at a location 328F, which is displaced from the axis 352 in the −x direction. Thus, the targets 320E and 320F are on different sides of the axis 352. The portion of the target 320E, 320F closest to the axis 352 (which is the most intense portion of the light beam 310) evaporates and converts to plasma before the remaining portions of the target 320E, 320F. The energy of the plasma generated from the target 320E is primarily emitted from the portion of the target 320E that is closest to the axis 352 and in a direction that is toward the axis 352. In the example shown, the energy emitted from the plasma generated from the target 320E is primarily emitted along a direction 363E, and the energy emitted from the plasma generated from the target 320F is primarily emitted along a direction 363F. The directions 363E, 363F are different from each other. As such, the relative placement of the target and the light beam also may be used to direct the energy emitted from the plasma in a particular direction. Additionally, although the targets 320E, 320F are shown as being spherical, targets of other shapes emit plasma directionally based on their location relative to the light beam 310.

FIGS. 3A-3C show the profiles 364A-364C, respectively, in the y-z plane and in two dimensions. However, it is contemplated that the profiles 364A-364C may occupy three dimensions and may sweep out a volume in three dimensions. Similarly, the energy emitted from the targets 320E and 320F may occupy a three-dimensional volume.

Figure 4:
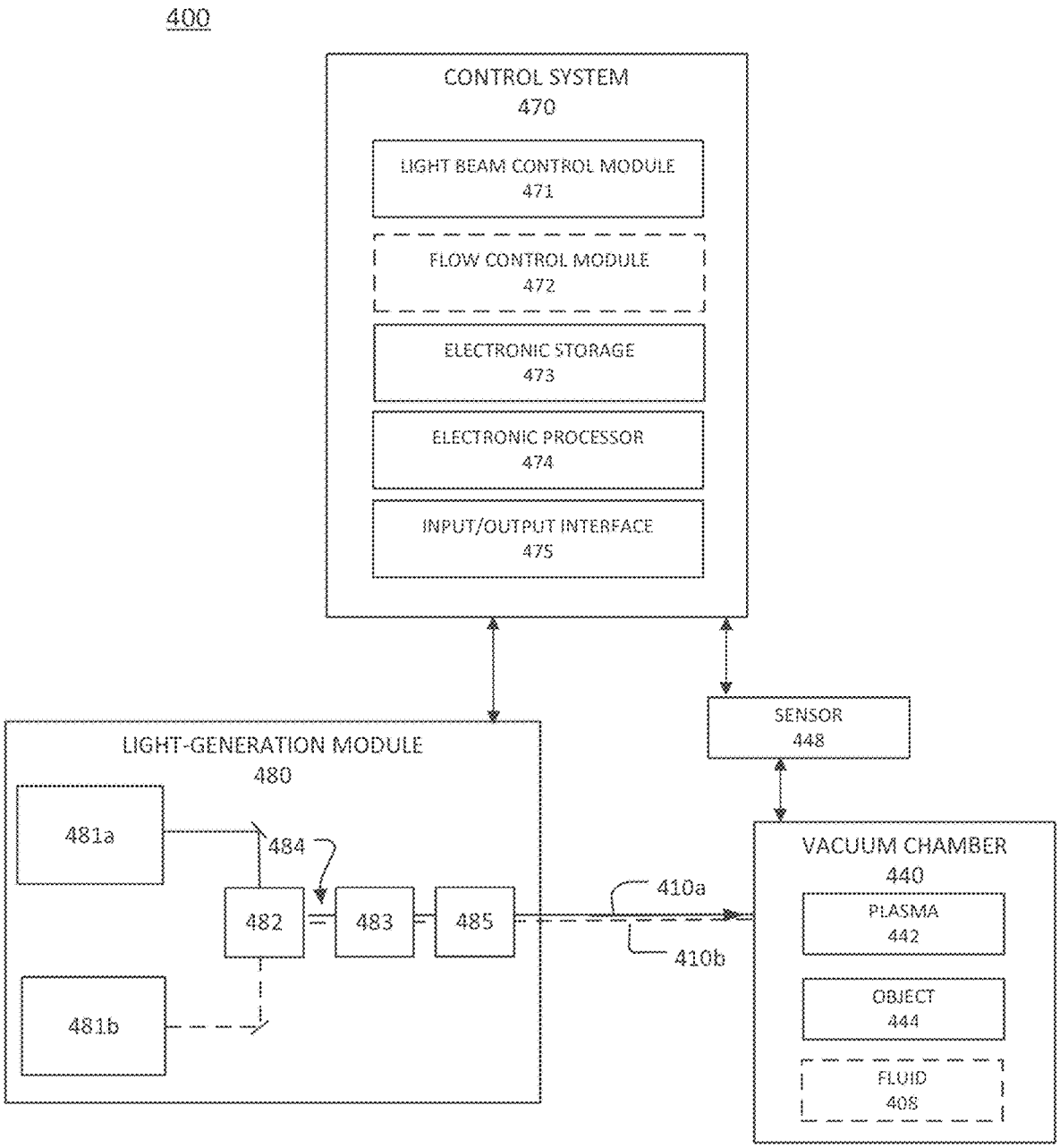
FIG. 4 is a block diagram of an exemplary system that includes a control system for controlling a position of a target.
Figure 5:
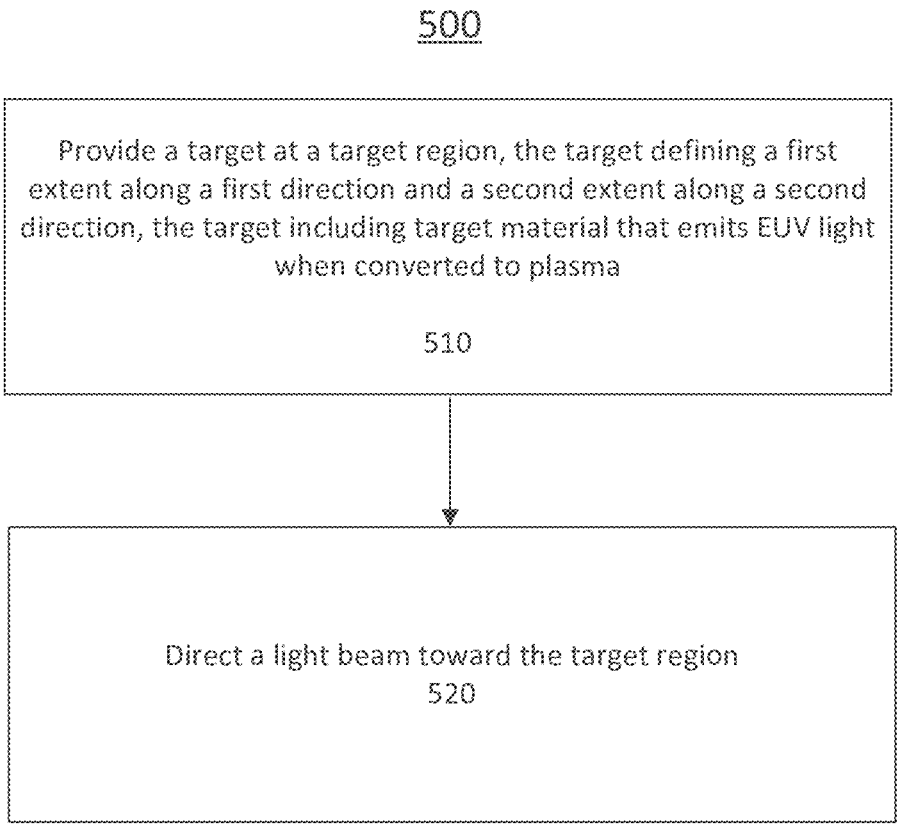
FIG. 5 is a flow chart of an exemplary process for generating EUV light.
Figure 6A:
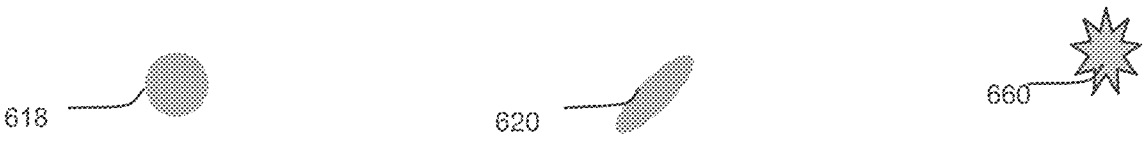
FIG. 6A shows an exemplary initial target that is converted to a target.
Figure 6B:
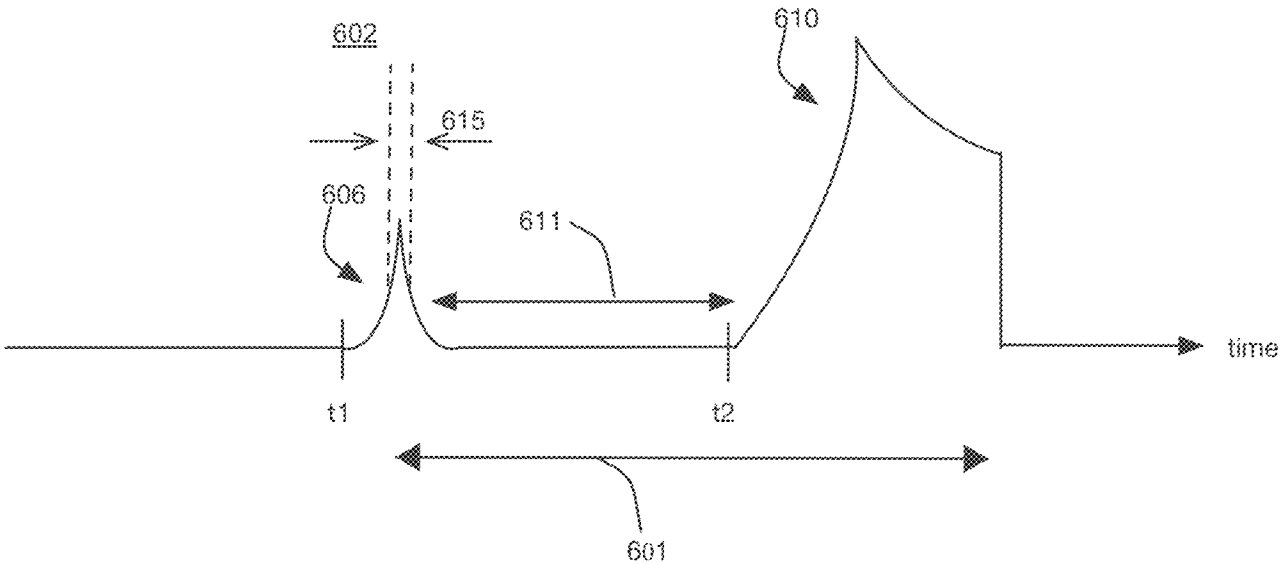
FIG. 6B is a plot of an exemplary waveform, shown as energy versus time, for generating the target of FIG. 6A.
Figure 6C:
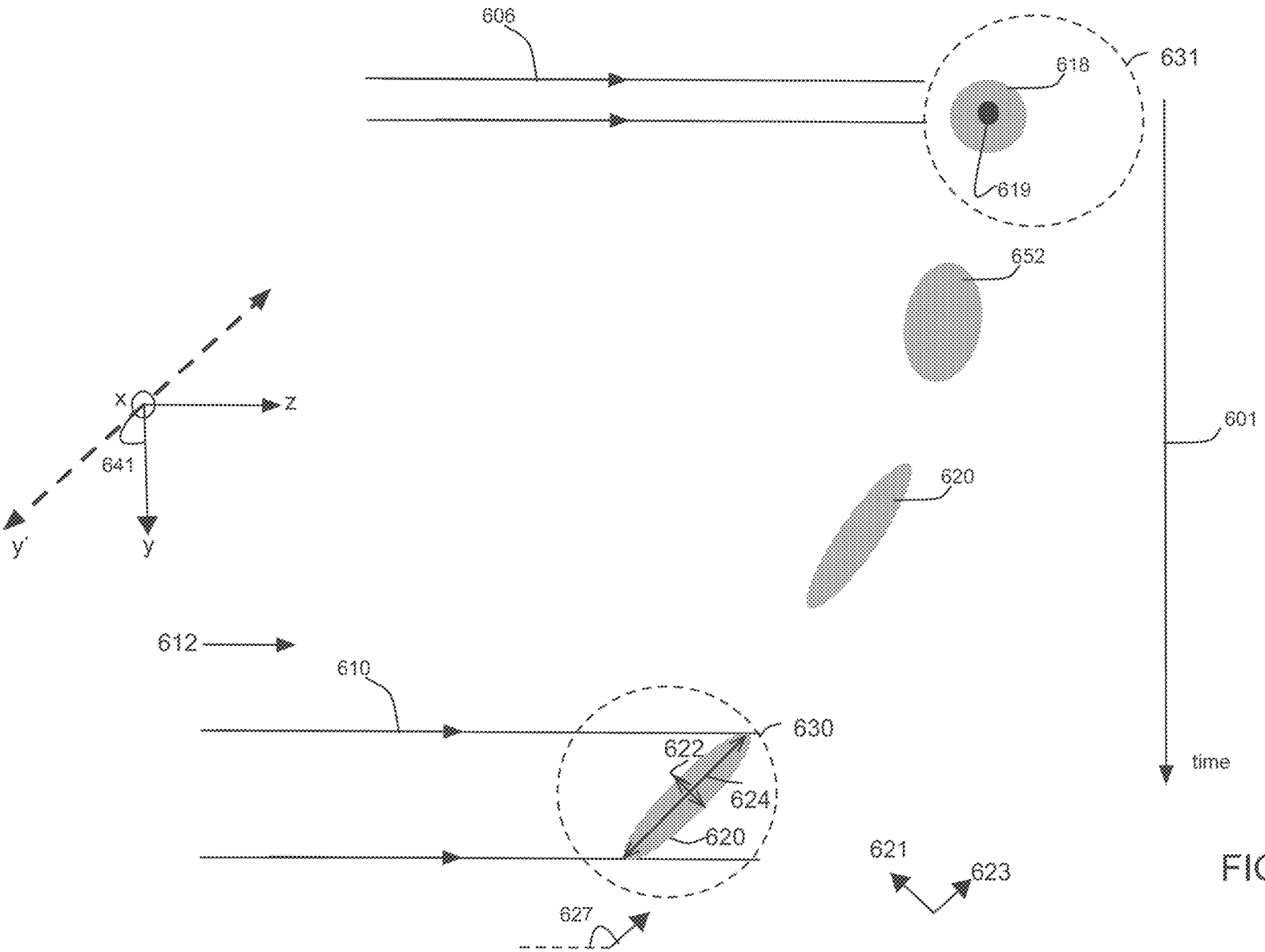
FIG. 6C shows side views of the initial target and the target of FIG. 6A.

FIG. 4 is a block diagram of a system 400 that can control the position of targets during use of an EUV light source. FIG. 5 is a flow chart of an exemplary process 500 for controlling the positioning of a target during use of an EUV light source. FIGS. 6A-6C illustrate an example of the process 500 for a target.

The control system 470 is used to reduce or eliminate the effects of a plasma 442, which is generated in a vacuum chamber 440, on an object 444 in the vacuum chamber 440. The plasma 442 is produced from an interaction between a light beam and target material at a target region in the vacuum chamber. The target material is released into the vacuum chamber 440 from a target source, and the target material travels from the target source (such as the target material supply apparatus 116 of FIG. 1) to the target region along a trajectory. The object 444 can be any object in the vacuum chamber 440 that is exposed to the plasma 442. For example, the object 444 can be another target for producing additional plasma, an optical element in the vacuum chamber 440, and/or a fluid 408 that flows in the vacuum chamber 440.

The system 400 also includes a sensor 448, which observes the interior of the vacuum chamber 440. The sensor 448 may be located in the vacuum chamber 440 or outside of the vacuum chamber 440. For example, the sensor 448 may be placed outside of the vacuum chamber at a viewport window that allows visual observation of the interior of the vacuum chamber 440. The sensor 448 is capable of sensing the presence of target material in the vacuum chamber. In some implementations, the system 400 includes an additional light source that produces a light beam or a sheet of light that intersects the trajectory of the target material. The light of the light beam or the sheet of light is scattered by the target material, and the sensor 448 detects the scattered light. The detection of the scattered light may be used to determine or estimate the location of the target material in the vacuum chamber 440. For example, the detection of the scattered light indicates that the target material is in a location that where the light beam or light sheet intersects the expected target material trajectory. Additionally or alternatively, the sensor 448 may be positioned to detect the light sheet or light beam, and the temporary blocking of the light sheet or light beam by the target material may be used as an indication that the target material is in a location that where the light beam or light sheet intersects the expected target material trajectory.

The sensor 448 may be a camera, photo detector, or another type of optical sensor that is sensitive to wavelengths in the light beam or light sheet that intersects the trajectory of the target material. The sensor 448 produces a representation of the interior of the vacuum chamber 440 (for example, a representation that indicates the detection of scattered light or an indication of light being blocked), and provides the representation to the control system 470. From the representation, the control system 470 may determine or estimate the location of the target material within the vacuum chamber 440 and declare that the target material is in a certain portion of the vacuum chamber 440. The location where the light beam or light sheet intersects the expected target material trajectory may be at any part of the trajectory. Further, in some implementations, other techniques for determining that the target material is in a particular portion of the vacuum chamber 440 may be used.

The system 400 includes a control system 470 that communicates with a light-generation module 480 to provide one or more light beams to a vacuum chamber 440. In the example shown, the light generation module 480 provides a first light beam 410*a* and a second light beam 410*b* to the vacuum chamber 440. In other examples, the light generation module 480 can provide more or fewer light beams.

The control system 470 controls the timing and/or direction of propagation of pulses of light emitted from the light-generation module 480 such that the positioning of a target in the vacuum chamber 440 can be changed from target-to-target. The control system 470 receives the representation of the interior of the vacuum chamber 440 from the sensor 448. From the representation, the control system 470 may determine whether target material is present in the vacuum chamber 440 and/or the position of the target material in the vacuum chamber 440. For example, the control system 470 may determine that target material is in a particular location of the vacuum chamber 440 or in a particular location in the vacuum chamber 440. When target material is determined to be in the vacuum chamber 440 or in a particular location in the vacuum chamber 440, the target material may be considered to be detected. The control system 470 may cause pulses to be emitted from the light-generation module 480 based on a detection of target material. The detection of target material may be used to time the emission of pulses from the light-generation module 480. For example, the emission of a pulse may be delayed or advanced based on detecting target material in a particular portion of the vacuum chamber 470. In another example, the direction of propagation of a pulse may be determined based on the detection of target material.

The control system 470 includes a light beam control module 471, a flow control module 472, an electronic storage 473, an electronic processor 474, and an input/output interface 475. The electronic processor 474 includes one or more processors suitable for the execution of a computer program such as a general or special purpose microprocessor, and any one or more processors of any kind of digital computer. Generally, an electronic processor receives instructions and data from a read-only memory or a random access memory or both. The electronic processor 474 can be any type of electronic processor.

The electronic storage 473 can be volatile memory, such as RAM, or non-volatile memory. In some implementations, and the electronic storage 473 can include non-volatile and volatile portions or components. The electronic storage 473 can store data and information that is used in the operation of the control system 470 and/or components of the control system 470. For example, the electronic storage 473 can store timing information that specifies when the first and second beams 410*a*, 410*b* are expected to propagate to specific locations in the vacuum chamber 440, a pulse repetition rate for the first and/or second beams 410*a*, 410*b* (in implementations in which the first and/or second beams 410*a*, 410*b* are pulsed light beams), and/or information that specifies a direction of propagation for the first and second beams 410*a*, 410*b* in the vicinity of the target (for example in a target region such as the target region 330).

The electronic storage 473 also can store instructions, perhaps as a computer program, that, when executed, cause the processor 474 to communicate with components in the control system 470, the light-generation module 480, and/or the vacuum chamber 440. For example, the instructions can be instructions that cause the electronic processor 474 to provide a trigger signal to the light-generation module 480 at certain times that are specified by the timing information stored on the electronic storage 473. The trigger signal can cause the light generation module 480 to emit a beam of light. The timing information stored on the electronic storage 473 may be based on information received from the sensor 448, or the timing information may be pre-determined timing information that is stored on the electronic storage 473 when the control system 470 is initially placed into service or through the actions of a human operator.

The I/O interface 475 is any kind of electronic interface that allows the control system 470 to receive and/or provide data and signals with an operator, the light-generation module 480, the vacuum chamber 440, and/or an automated process running on another electronic device. For example, the I/O interface 475 can include one or more of a visual display, a keyboard, or a communications interface.

The light beam control module 471 communicates with the light-generation module 480, the electronic storage 473, and/or the electronic processor 474 to direct pulses of light into the vacuum chamber 440.

The light generation module 480 is any device or optical source that is capable of producing pulsed light beams, at least some of which have energy sufficient to convert target material to plasma that emits EUV light. Additionally, the light-generation module 480 can produce other light beams that do not necessarily transform target material to plasma, such as light beams that are used to shape, position, orient, expand, or otherwise condition an initial target into a target that is converted into plasma that emits EUV light.

In the example of FIG. 4, the light-generation module 480 includes two optical subsystems 481*a*, 481*b*, which produce first and second light beams 410*a*, 410*b*, respectively. In the example of FIG. 4, the first light beam 410*a* is represented by a solid line and the second light beam 410*b* is represented by a dashed line. The optical subsystems 481*a*, 481*b* can be, for example, two lasers. For example, the optical subsystems 481*a*, 481*b* can be two carbon dioxide ($CO_2$) lasers. In other implementations, the optical subsystems 481*a*, 481*b* can be different types of lasers. For example, the optical subsystem 481*a* can be a solid state laser, and the optical subsystem 481*b* can be a $CO_2$ laser. Either or both of the first and second light beams 410*a*, 410*b* can be pulsed.

The first and second light beams 481*a*, 481*b* can have different wavelengths. For example, in implementations in which the optical subsystems 481*a*, 481*b* include two $CO_2$ lasers, the wavelength of the first light beam 410*a* can be about 10.26 micrometers (μm) and the wavelength of the second light beam 410*b* can be between 10.18 μm and 10.26 μm. The wavelength of the second light beam 410*b* can be about 10.59 μm. In these implementations, the light beams 410*a*, 410*b* are generated from different lines of the $CO_2$ laser, resulting in the light beams 410*a*, 410*b* having different wavelengths even though both beams are generated from the same type of source. The light beams 410*a*, 410*b* also can have different energies.

The light-generation module 480 also includes a beam combiner 482, which directs the first and second beams 410*a*, 410*b* onto a beam path 484. The beam combiner 482 can be any optical element or a collection of optical elements capable of directing the first and second beams 410*a*, 410*b* onto the beam path 484. For example, the beam combiner 482 can be a collection of mirrors, some of which are positioned to direct the first beam 410*a* onto the beam path 484 and others of which are positioned to direct the second beam 410*b* onto the beam path 484. The light-generation module 480 also can include a pre-amplifier 483, which amplifies the first and second beams 410*a*, 410*b* within the light-generation module 480.

The first and second beams 410*a*, 410*b* can propagate on the path 484 at different times. In the example shown in FIG. 4, the first and second beams 410*a*, 410*b* follow the path 484 in the light-generation module 480, and both beams 410*a*, 410*b* traverse substantially the same spatial region through the optical amplifier 483. In other examples, the beams 410*a* and 410*b* can travel along different paths, including through two different optical amplifiers.

Figure 14:
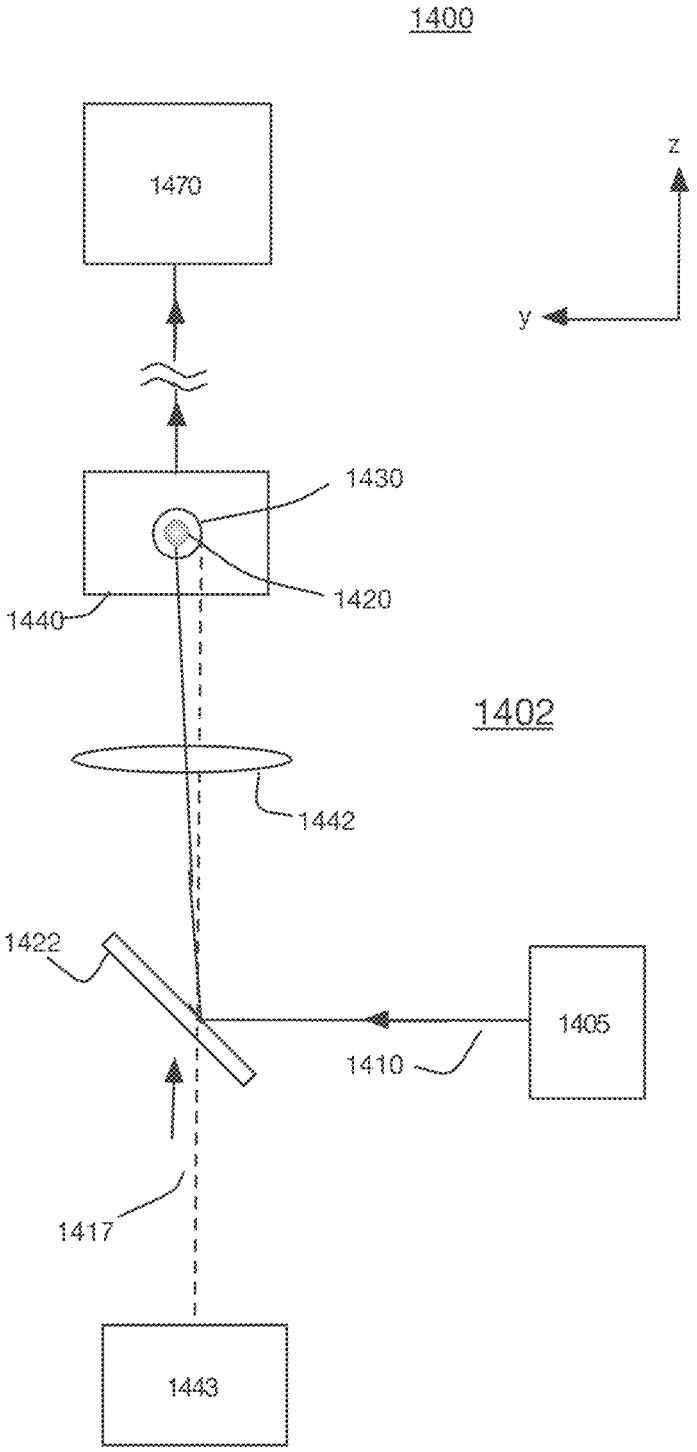
FIG. 14 is a block diagram of an exemplary optical lithography system that includes an EUV light source.

The first and second light beams 410*a*, 410*b* are directed to the vacuum chamber 440. The first and second beams 410*a*, 410*b* are angularly disbursed by a beam delivery system 485 such that the first beam 410*a* is directed toward an initial target region, and the second beam 410*b* is directed toward a target region (such as the target region 130 of FIG. 1). The initial target region is a volume of space in the vacuum chamber 440 that receives the first light beam 410*a* and initial target material, which is conditioned by the first light beam 410*a*. The target region is a volume of space in the vacuum chamber 440 that receives the second light beam 410*b* and a target that is converted into plasma. The initial target region and the target region are at different locations within the vacuum chamber 440. For example, and referring to FIG. 1, the initial target region can be displaced in the −y direction relative to the target region 130 such that the initial target region is between the target region 130 and the target material supply 116. The initial target region and the target region can partially spatially overlap, or the initial target region and the target region can be spatially distinct without any overlap. FIG. 14 includes an example of first and second light beams being displaced from each other within a vacuum chamber. In some implementations, the beam delivery system 485 also focuses the first and second beams 410*a*, 410*b* to locations within or near the initial and modified target regions, respectively.

In other implementations, the light-generation module 480 includes a single optical subsystem that generates both the first and second light beams 410*a*, 410*b*. In these implementations, the first and second light beams 410*a*, 410*b* are generated by the same optical source or device. However, the first and second light beams 410*a*, 410*b* can have the same wavelength or different wavelengths. For example, the single optical subsystem can be a carbon dioxide ($CO_2$) laser, and the first and second light beams 410*a*, 410*b* can be generated by different lines of the $CO_2$ laser and can be different wavelengths.

Figure 17:
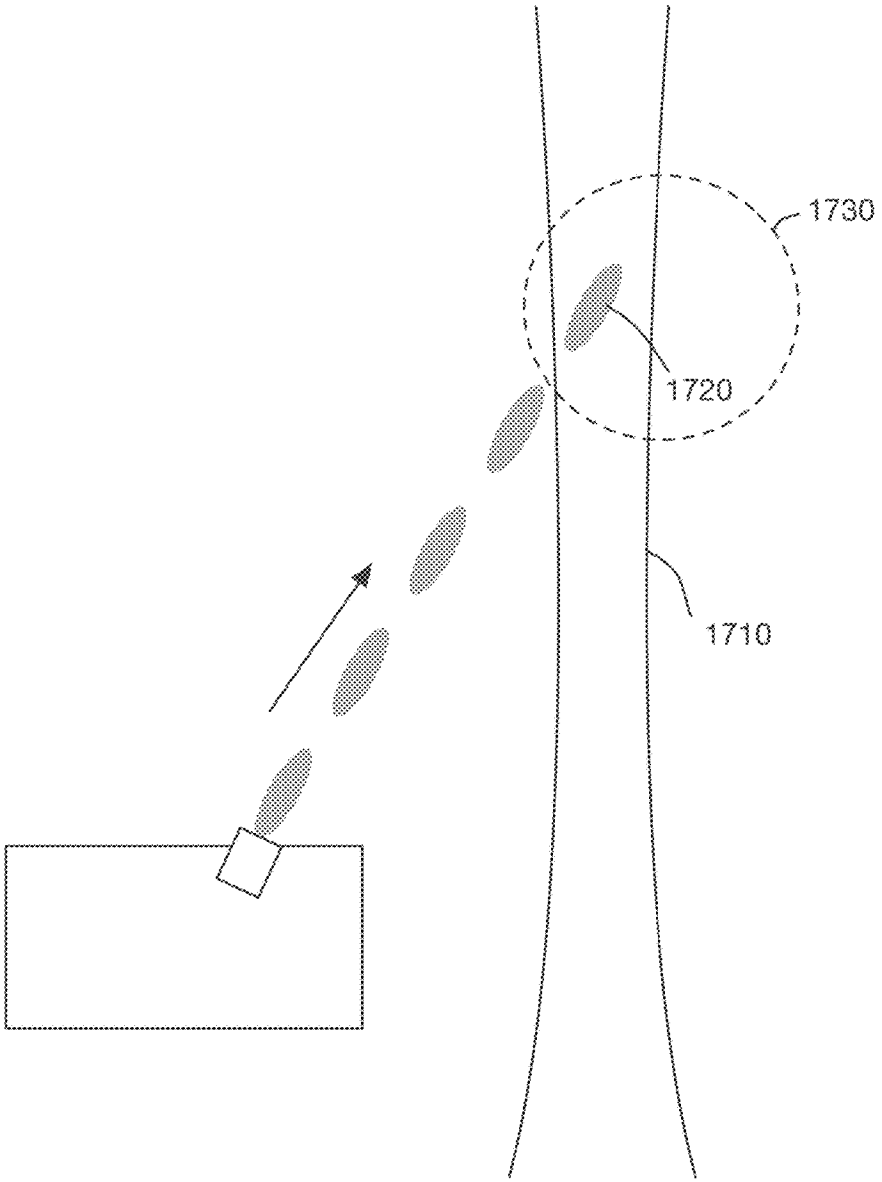
FIG. 17 is a block diagram of an exemplary target material supply apparatus that can be used in an EUV light source.

In some implementations, the light-generation module 480 does not emit the first light beam 410*a* and there is no initial target region. In these implementations, the target is received in the target region without being pre-conditioned by the first light beam 410*a*. An example of such an implementation is shown in FIG. 17.

A fluid 408 can flow in the vacuum chamber 440. The control system 470 also may control the flow of the fluid 408 in the vacuum chamber 440. The fluid 408 may be, for example, hydrogen and/or other gasses. The fluid 408 can be the object 444 (or one of the objects 444 in the case where multiple objects in the vacuum chamber 440 are to be protected from the effects of the plasma 442). In these implementations, the control system 470 also can include a flow control module 472, which controls a flow configuration of the fluid 408. The flow control module 472 can set, for example, the flow rate and/or flow direction of the fluid 408.

The light beam control module 471 controls the light generation module 480 and determines when the first light beam 410*a* is emitted from the light-generation module 480 (and, thus, when the first light beam 410*a* reaches the initial target region and the target region). The light beam control module 471 also can determine a direction of propagation of the first light beam 410*a*. By controlling the timing and/or direction of the first light beam 410*a*, the light beam control module 471 also can control a position of a target and the direction in which particles and/or radiation are primarily emitted.

FIGS. 5 and 6A-6C discuss a technique for positioning the target using a pre-pulse, or a pulse of light that reaches the target prior to a pulse of radiation that converts the target material to plasma that emits EUV light.

Referring to FIG. 5, a flow chart of an exemplary process 500 for generating EUV light is shown. The process 500 can also be used to tilt a target (such as the target 120 of FIG. 1, the target 220 of FIG. 2A, or the target 320 of FIGS. 3A and 3B). The target is provided at a target region (510). The target has a first extent along a first direction and a second extent along a second direction. The target includes target material that emits EUV light when converted to plasma. An amplified light beam is directed toward the target region (520).

FIGS. 6A-6C show an example of the process 500. As discussed below, a target 620 is provided to a target region 630 (FIG. 6C), and an amplified light beam 610 is directed toward the target region 630.

Referring to FIGS. 6A and 6B, an exemplary waveform 602 transforms an initial target 618 into the target 620. The initial target 618 and the target 620 include target material that emits EUV light 660 when converted to plasma through irradiation with an amplified light beam 610 (FIG. 6C). The discussion below provides an example in which the initial target 618 is a droplet made of molten metal. For example, the initial target 618 can be substantially spherical and have a diameter of 30-35 μm. However, the initial target 618 can take other forms.

FIGS. 6A and 6C show a time period 601 during which the initial target 618 physically transforms into the target 620 and then emits EUV light 660. The initial target 618 is transformed through interaction with the radiation delivered in time according to the waveform 602. FIG. 6B is a plot of the energy in the waveform 602 as a function of time over the time period 601 of FIG. 6A, As compared to the initial target 618, the target 620 has a side cross section with an extent that is less in the z direction. Additionally, the target 620 is tilted relative to the z direction (the direction 612 of propagation of the amplified beam 610 that converts at least part of the target 620 to plasma).

The waveform 602 includes a representation of a pulse of radiation 606 (a pre-pulse 606). The pre-pulse 606 can be, for example, a pulse of the first light beam 410*a* (FIG. 4). The pre-pulse 606 can be any type of pulsed radiation that has sufficient energy to act on the initial target 618, but the pre-pulse 606 does not convert a significant amount of the target material to plasma that emits EUV light. The interaction of the first pre-pulse 606 and the initial target 618 can deform the initial target 618 into a shape that is closer to a disk. After about 1-3 microseconds (μs), this deformed shape expands into a disk shaped piece or form of molten metal. The amplified light beam 610 can be referred to as the main beam or the main pulse. The amplified light beam 610 has sufficient energy to convert target material in the target 620 to plasma that emits EUV light.

The pre-pulse 606 and the amplified light beam 610 are separated in time by a delay time 611, with the amplified light beam 610 occurring at time $t_2$, which is after the pre-pulse 606. The pre-pulse 606 occurs at a time $t=t_1$ and has a pulse duration 615. The pulse duration 615 can be represented by the full width at half maximum, the amount of time that the pulse has an intensity that is at least half of the maximum intensity of the pulse. However, other metrics can be used to determine the pulse duration 615.

Before discussing the technique of providing the target 620 to the target region 630, a discussion of the interactions of the pulses of radiation, including the pre-pulse 606, with the initial target 618 is provided.

When a laser pulse impinges (strikes) a metallic target material droplet, the leading edge of the pulse sees (interacts with) a surface of the droplet that is a reflective metal. The leading edge of the pulse is the part of the pulse that interacts with the target material first, before any other parts of the pulse. The initial target 618 reflects most of the energy in the leading edge of the pulse and absorbs little. The small amount of light that is absorbed heats the surface of the droplet, evaporating and ablating the surface. The target material that is evaporated from the surface of the droplet forms a cloud of electrons and ions close to the surface. As the pulse of radiation continues to impinge on the target material droplet, the electric field of the laser pulse can cause the electrons in the cloud to move. The moving electrons collide with nearby ions, heating the ions through the transfer of kinetic energy at a rate that is roughly proportional to the product of the densities of the electrons and the ions in the cloud. Through the combination of the moving electrons striking the ions and the heating of the ions, the cloud absorbs the pulse.

As the cloud is exposed to the later parts of the laser pulse, the electrons in the cloud continue to move and collide with ions, and the ions in the cloud continue to heat. The electrons spread out and transfer heat to the surface of the target material droplet (or bulk material that underlies the cloud), further evaporating the surface of the target material droplet. The electron density in the cloud increases in the portion of the cloud that is closest to the surface of the target material droplet. The cloud can reach a point where the density of electrons increases such that the portions of the cloud reflect the laser pulse instead of absorbing it.

Referring also to FIG. 6C, the initial target 618 is provided at an initial target region 631. The initial target 618 can be provided at the initial target region 631 by, for example, releasing target material from the target material supply apparatus 116 (FIG. 1). In the example shown, the pre-pulse 606 strikes the initial target 618, transforms the initial target 618, and the transformed initial target drifts or moves into the target region 630 over time.

The force of the pre-pulse 606 on the initial target 618 causes the initial target 618 to physically transform into a geometric distribution 652 of target material. The geometric distribution 652 can include a material that is not ionized (a material that is not a plasma). The geometric distribution 652 can be, for example, a disk of liquid or molten metal, a continuous segment of target material that does not have voids or substantial gaps, a mist of micro- or nano-particles, or a cloud of atomic vapor. The geometric distribution 652 further expands during the delay time 611 and becomes the target 620. Spreading the initial target 618 can have three effects.

First, as compared to the initial target 618, the target 620 generated by the interaction with the pre-pulse 606 has a form that presents a larger area to an oncoming pulse of radiation (such as the amplified light beam 610). The target 620 has a cross-sectional diameter in the y direction that is larger than the cross-sectional diameter in the y direction of the initial target 618. Additionally, the target 620 can have a thickness that is thinner in a direction of propagation (612 or z) of the amplified light beam 610 at the target 620 than the initial target 618. The relative thinness of the target 620 in the direction z allows the amplified light beam 610 to irradiate more of the target material that is in the target 618.

Second, spreading the initial target 618 out in space can minimize or reduce the occurrence of regions of excessively high material density during heating of the plasma by the amplified light beam 610. Such regions of excessively high material density can block generated EUV light. If the plasma density is high throughout a region that is irradiated with a laser pulse, absorption of the laser pulse is limited to the portions of the region that receives the laser pulse first. Heat generated by this absorption may be too distant from the bulk target material to maintain the process of evaporating and heating of the target material surface long enough to utilize (for example, evaporate and/or ionize) a meaningful amount of the bulk target material during the finite duration of the amplified light beam 610.

In instances where the region has a high electron density, the light pulse only penetrates a fraction of the way into the region before reaching a "critical surface" where the electron density is so high that the light pulse is reflected. The light pulse cannot travel into those portions of the region and little EUV light is generated from target material in those regions. The region of high plasma density can also block EUV light that is emitted from the portions of the region that do emit EUV light. Consequently, the total amount of EUV light that is emitted from the region is less than it would be if the region lacked the portions of high plasma density. As such, spreading the initial target 618 into the larger volume of the target 620 means that an incident light beam reaches more of the material in the target 620 before being reflected. This can increase the amount of EUV light produced.

Third, the interaction of the pre-pulse 606 and the initial target 618 causes the target 620 to arrive at the target region 630 tilted at an angle 627 with respect to the direction of propagation 612 of the amplified light beam 610. The initial target 618 has a center of mass 619, and the pre-pulse 606 strikes the initial target 618 such that the majority of the energy in the pre-pulse 606 falls on one side of the center of mass 619. The pre-pulse 606 applies a force to the initial target 618, and, because the force is on one side of the center of mass 619, the initial target 618 expands along a different set of axes than the target would if the pre-pulse 606 struck the initial target 618 at the center of mass 619. The initial target 618 flattens along the direction is from which it is hit by the pre-pulse 606. Thus, striking the initial target 618 off-center or away from the center of mass 619 produces a tilt. For example, when the pre-pulse 606 interacts with the initial target 618 away from the center of mass 619, the initial target 618 does not expand along the y axis and instead expands along an axis y', which is tilted at an angle 641 relative to the y axis while moving toward the target region 630. Thus, after the time period has elapsed, the initial target 618 has transformed into the target 620, which occupies an expanded volume and is tilted at the angle 627 with respect to the direction 612 of propagation of the amplified light beam 610.

FIG. 6C shows a side cross-section of the target 620. The target 620 has an extent 622 along a direction 621 and an extent 624 along a direction 623, which is orthogonal to the direction 621. The extent 624 is greater than the extent 622, and the extent 624 forms the angle 627 with the direction 612 of propagation of the amplified light beam 610. The target 620 can be placed so that part of the target 620 is in a focal plane of the amplified light beam 610, or the target 620 can be placed away from the focal plane. In some implementations, the amplified light beam 610 can be approximated as a Gaussian beam, and the target 620 can be placed outside of the depth of focus of the amplified light beam 610.

In the example shown in FIG. 6C, the majority of the intensity of the pre-pulse 606 strikes the initial target 618 above (offset in the −y direction) the center of mass 619, causing the target material in the initial target 618 to expand along the y' axis. However, in other examples, the pre-pulse 606 can be applied below (offset in they direction) the center of mass 619, causing the target 620 to expand along an axis (not shown) that is counterclockwise compared to the y' axis. In the example shown in FIG. 6C, the initial target 618 drifts through the initial target region 631 while traveling along the y direction. Thus, the portion of the initial target 618 upon which the pre-pulse 606 is incident can be controlled with the timing of the pre-pulse 606. For example, releasing the pre-pulse 606 at an earlier time than the example shown in FIG. 6C (that is, increasing the delay time 611 of FIG. 6B), causes the pre-pulse 606 to strike the lower portion of the initial target 618.

The pre-pulse 606 can be any type of radiation that can act on the initial target 618 to form the target 620. For example, the pre-pulse 606 can be a pulsed optical beam generated by a laser. The pre-pulse 606 can have a wavelength of 1-10 μm. The duration 612 of the pre-pulse 606 can be, for example, 20-70 nanoseconds (ns), less than 1 ns, 300 picoseconds (ps), between 100-300 ps, between 10-50 ps, or between 10-100 ps. The energy of the pre-pulse 606 can be, for example, 15-60 milliJoules (mJ), 90-110 mJ, or 20-125 mJ. When the pre-pulse 606 has a duration of 1 ns or less, the energy of the pre-pulse 606 can be 2 mJ. The delay time 611 can be, for example, 1-3 microseconds (μs).

The target 620 may have a diameter of, for example, 200-600 μm, 250-500 μm, or 300-350 μm. The initial target 618 may travel toward the initial target region 631 with a velocity of, for example, 70-120 meters per second (m/s). The initial target 618 may travel at a velocity of 70 m/s or 80 m/s. The target 620 may travel at a higher or lower velocity than the initial target 610. For example, the target 620 may travel toward the target region 630 at a velocity that 20 m/s faster or slower than the initial target 610. In some implementations, the target 620 travels at the same velocity as the initial target 610. Factors that influence the velocity of the target 620 include the size, shape, and/or angle of the target 620. The width of the light beam 610 at the target region 630 in the y direction may be 200-600 μm. In some implementations, the width of the light beam 610 in the y direction is approximately the same as the width of the target 620 in the y direction at the target region 630.

Although the waveform 602 is shown as a single waveform as a function of time, various portions of the waveform 602 can be produced by different sources. Furthermore, although the pre-pulse 606 is shown as propagating in the direction 612, this is not necessarily the case. The pre-pulse 606 can propagate in another direction and still cause the initial target 618 to tilt. For example, the pre-pulse 606 can propagate in a direction that is at the angle 627 relative to the z direction. When the pre-pulse 606 travels in this direction and impacts the initial target 618 at the center of mass 619, the initial target 618 expands along the y' axis and is tilted. Thus, in some implementations, the initial target 618 can be tilted relative to the direction of propagation of the amplified light beam 610 by striking the initial target 618 on-center or at the center of mass 619. Striking the initial target 618 in this manner causes the initial target 618 to flatten or expand along a direction that is perpendicular to the direction in which the pre-pulse 606 propagates, thus angling or tilting the initial target 618 relative to the z axis. Additionally, in other examples, the pre-pulse 606 can propagate in other directions (for example, out of the page of FIG. 6C and along the x axis) and cause the initial target 618 to flatten and tilt relative to the z axis.

As discussed above, the impact of the pre-pulse 606 on the initial target 618 deforms the initial target 618. In implementations in which the initial target 618 is a droplet of molten metal, the impact transforms the initial target 618 into a shape that is similar to a disk, the disk expands into the target 620 over the time of the delay 611. The target 620 arrives in the target region 630.

Although FIG. 6C illustrates an implementation in which the initial target 618 expands into the target 620 over the delay 611, in other implementations, the target 620 is tilted and expanded along a direction that is orthogonal to the direction of propagation of the pre-pulse 606 by adjusting the spatial position of the pre-pulse 606 and the initial target 618 relative to each other, and without necessarily using the delay 611. In this implementation, the spatial position of the pre-pulse 606 and the initial target 618 are adjusted relative to each other. Due to this spatial offset, an interaction between the pre-pulse 606 and the initial target 618 causes the initial target 618 to tilt in a direction that is orthogonal to the direction of propagation of the pre-pulse 606. For example, the pre-pulse 606 can propagate into the page of FIG. 6C to expand and tilt the initial target 618 relative to the direction of propagation of the amplified light beam 610.

Figure 7A:
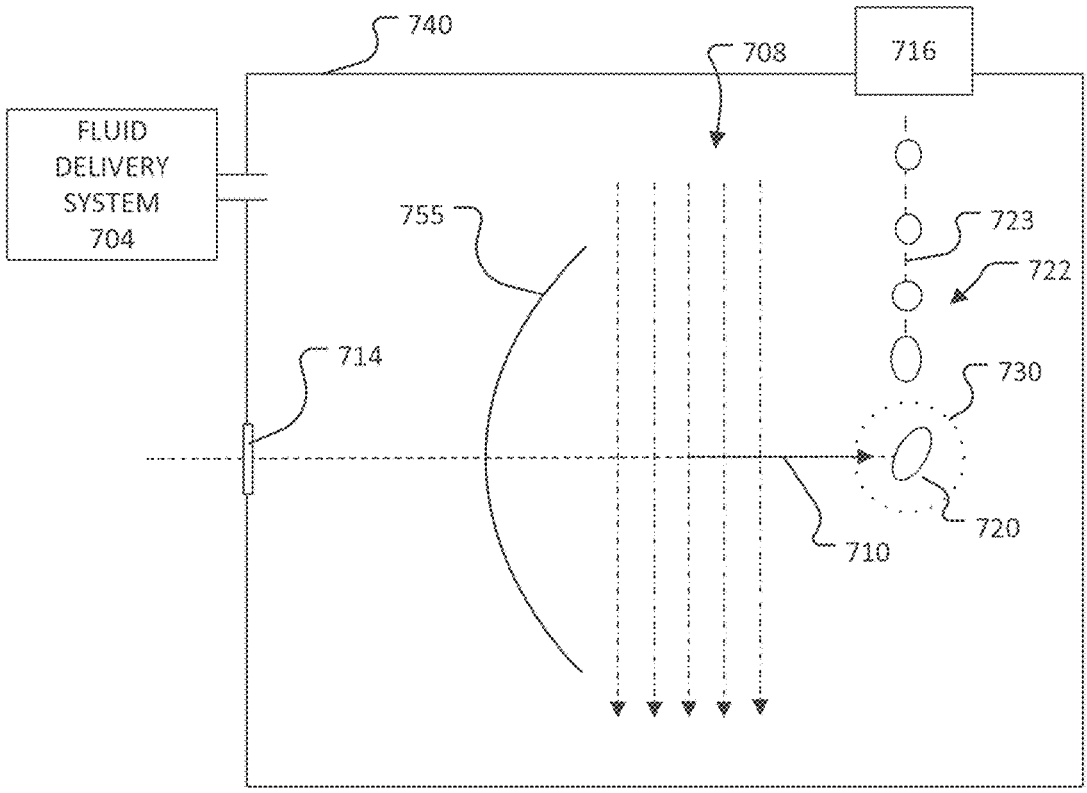
FIGS. 7A and 7B are block diagrams of an exemplary vacuum chamber.
Figure 7B:
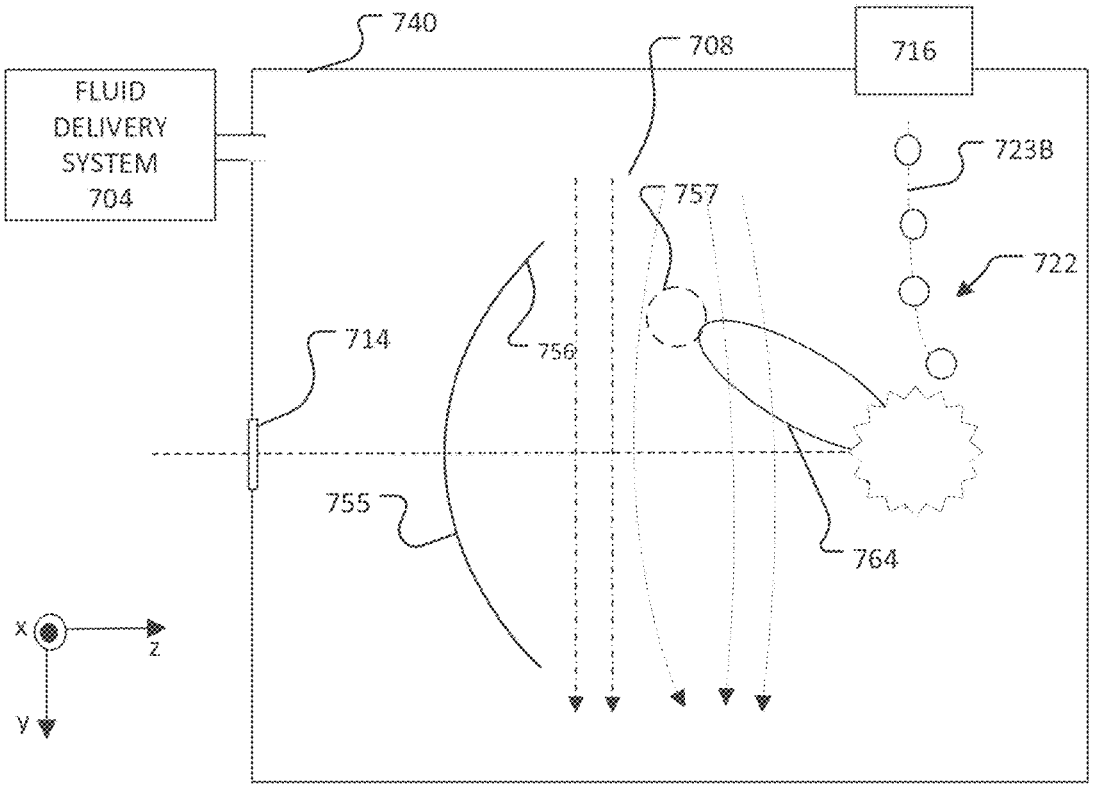
Figure 8:
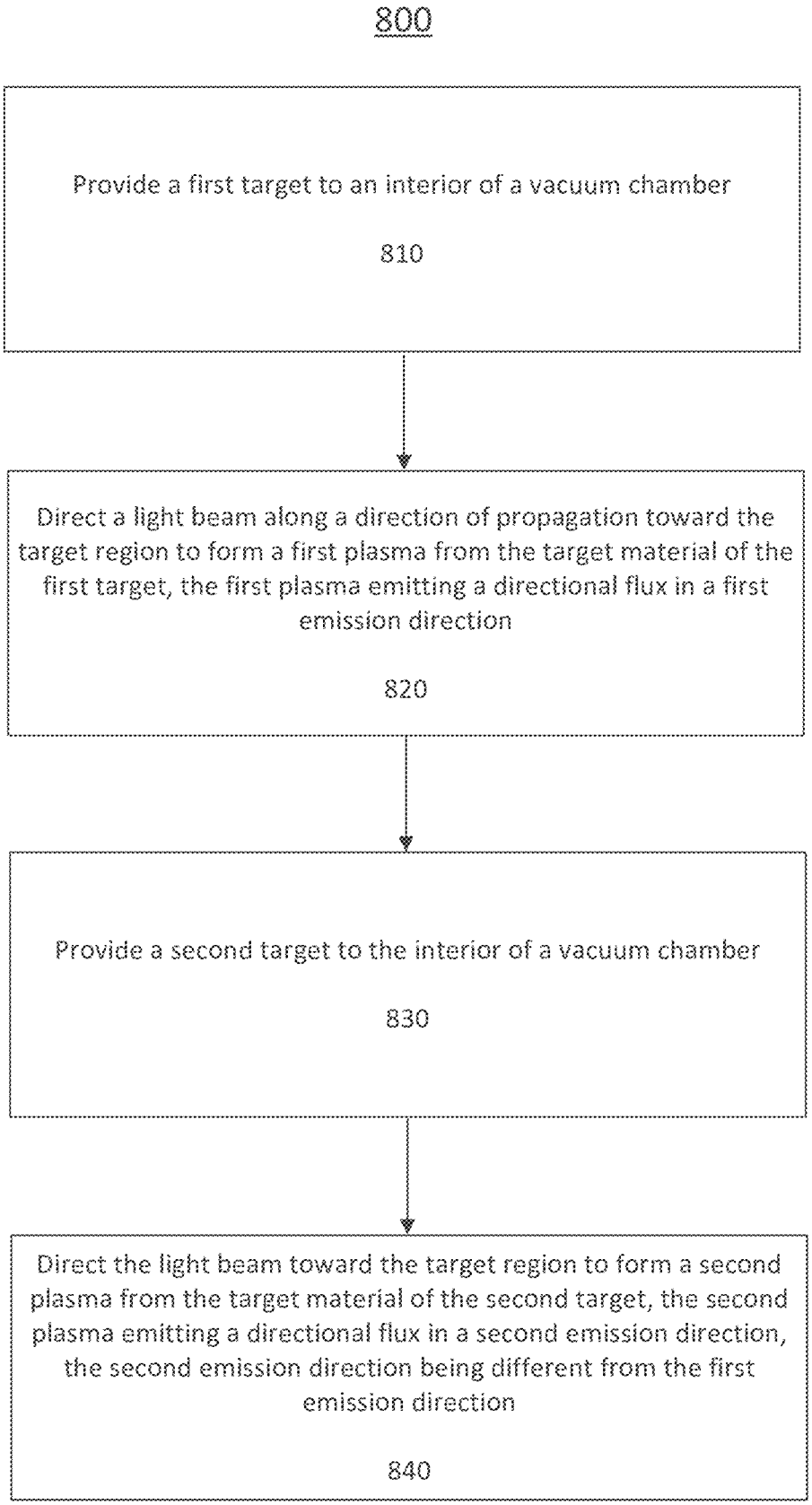
FIG. 8 is a flow chart of an exemplary process for varying the positions of targets.

FIG. 8 discusses an example of causing a position of at least two targets in a stream of droplets to be different. Before turning to FIG. 8, FIGS. 7A and 7B provide an example of a system in which the position of a target remains the same over time (that is, each target that arrives in the target region has substantially the same orientation and/or position in the vacuum chamber).

Referring to FIGS. 7A and 7B, an interior of an exemplary vacuum chamber 740 is shown at two times. The example of FIGS. 7A and 7B illustrates the effect of a directionally dependent flux of particles and/or radiation associated with a plasma on objects in the vacuum chamber 740 when the positions of the targets that enter the target region is not varied or changed over time by the control system 470. In the example of FIGS. 7A and 7B, the objects are a fluid 708 and targets 720 in a stream 722.

The fluid 708 is between a target region 730 and an optical element 755 and is intended to act as a buffer that protects the optical element 755 from the plasma. The fluid 708 may be a gas, such as, for example, hydrogen. The fluid 708 may be introduced into the vacuum chamber 740 by a fluid delivery system 704. The fluid 708 has a flow configuration, which describes the intended characteristics of the fluid 708. The flow configuration is intentionally selected such that the fluid 708 protects the optical element 755. The flow configuration may be defined by, for example, a flow rate, a flow direction, flow location, and/or a pressure or density of the fluid 708. In the example of FIG. 7A, the flow configuration results in the fluid 708 flowing through the region between the target region 730 and the optical element 755 and forming a uniform volume of gas between the target region 730 and the optical element 755. The fluid 708 may flow in any direction. In the example of FIG. 7A, the fluid 708 flows in the y direction based on the flow configuration.

Referring also to FIG. 7B, the interaction between the target 720 and the light beam 710 produces the directionally dependent flux of particles and/or radiation. The distribution of the particles and/or radiation is represented by the profile 764 (FIG. 7B). The distribution profile 764 is substantially the same shape and position for each target 720 that is converted to plasma in the target region 730. The particles and/or radiation emitted from the plasma enter the fluid 708 and may change the flow configuration. These changes can result in damage to the optical element 755 and/or changes to the trajectory 723.

For example, as discussed above, the directionally dependent flux of particles and/or radiation may include high-energy ions that are primarily emitted in a direction that is determined by the position of the target 720, which remains constant for all targets entering the target region 730 for the example of FIGS. 7A and 7B. High-energy ions released from the plasma travel in the fluid 708, and may be stopped by the fluid 708 before reaching the optical element 755. Ions stopped in the fluid transfer kinetic energy into the fluid 708 as heat. Because the majority of the high-energy ions are emitted in the same direction and travel approximately the same distance into the fluid 708, the high-energy ions can form a heated localized volume 757 within the fluid 708 that is warmer than the rest of the fluid 708. The viscosity of the fluid 708 increases with temperature. Thus, the viscosity of the fluid in the heated localized volume 757 is greater than the viscosity of the surrounding fluid 708. Due to the higher viscosity, fluid flowing toward the volume 757 experiences a greater resistance in the volume 757 than the surrounding region. As a result, the fluid tends to flow around the volume 757, deviating from the intended flow configuration of the fluid 708.

Additionally, in instances in which the heated localized volume 757 arises from metallic ion deposits, the volume 757 may include a gas that contains a high amount of the metallic material that produced the ions. In these instances, if the direction of the profile 764 remains constant over time, the amount of metallic material in the volume 757 can become so high that the flowing fluid 708 is no longer able to carry the metal material away from the volume 757. When the fluid 708 is no longer able to carry the metallic material away from the volume 757, the metallic material can escape from the volume 757 and impact a region 756 of the optical. element 755, resulting in contamination of the region 756 of the optical element 755. The region 756 can be referred to as the "contamination region."

Referring also to FIG. 7C, the optical element 755 is shown. The optical element 755 includes a reflective surface 759 and an aperture 758 through which the light beam 710 propagates. The contamination region 756 is formed on a portion of the reflective surface 759. The contamination region 756 can be any shape and can cover any portion of the reflective surface 759, but the location of the contamination region 756 on the reflective surface 759 depends on the distribution of the directional flux of particles and/or radiation.

Referring to FIG. 7B, the presence of the heated localized volume 757 also may change the location and/or shape of the trajectory 723 by changing the amount of drag on the targets that travel on the trajectory 723. As shown in FIG. 7B, in the presence of the heated localized volume 757, the targets 720 may travel on a trajectory 723B, which is different from the expected trajectory 723. By traveling on the changed trajectory 723B, the targets 720 may arrive in the target region 730 at the wrong time (for example, when the light beam 710 or a pulse of the light beam 710 is not in the target region 730) and/or not arrive at the target region 730 at all, leading to reduced or no EUV light production.

Thus, it is desirable to spatially distribute the heating caused by the directional flux of particles and/or radiation. Referring to FIG. 8, an exemplary process 800 for varying the position of a target that arrives in the target region as compared to the position of other targets that arrive in the target region is shown. In this way, the target position is considered to be varied over time, and any of the positions of the targets can be different from the positions of the other targets. By varying the positions of the various targets, the heat produced by the plasma is spread out in space, thereby protecting an object in a vacuum chamber from the effects of the plasma. The process can be performed by the control system 470 (FIG. 4). The process 800 can be used to reduce the effect of plasma on one or more objects in a vacuum chamber in which plasma is formed, such as a vacuum chamber of an EUV light source. For example, the process 800 can be used to protect objects in the vacuum vessel 140 (FIG. 1), 440 (FIG. 4), or 740 (FIG. 7).

Figure 9A:
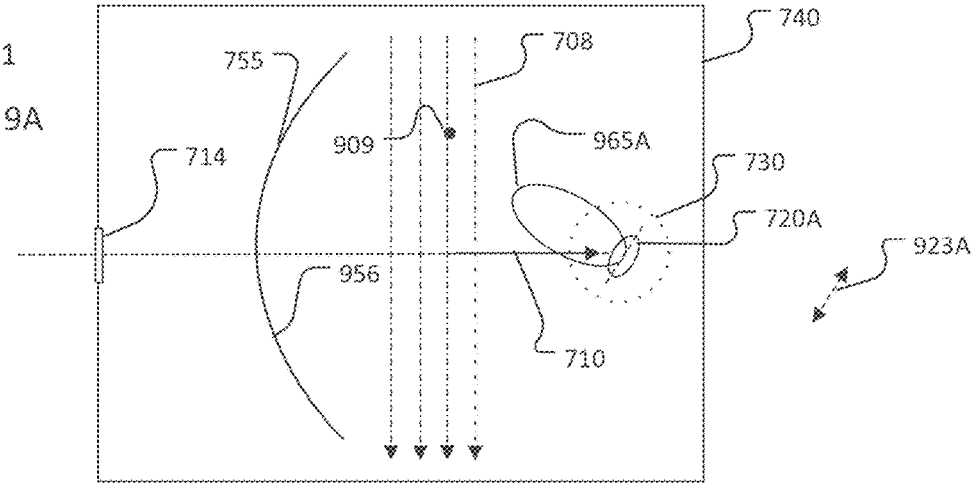
FIGS. 9A-9C are block diagrams of an exemplary vacuum chamber that includes a target that has a position that varies with time.
Figure 9B:
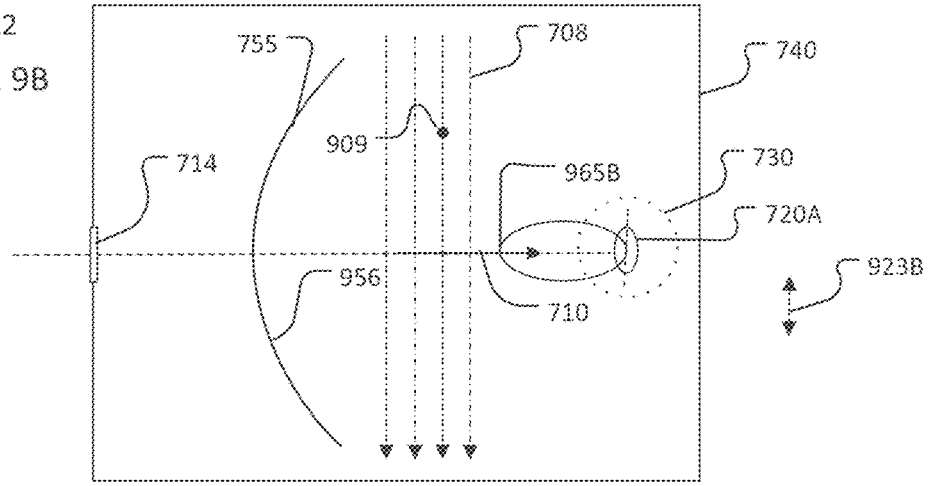
Figure 9C:
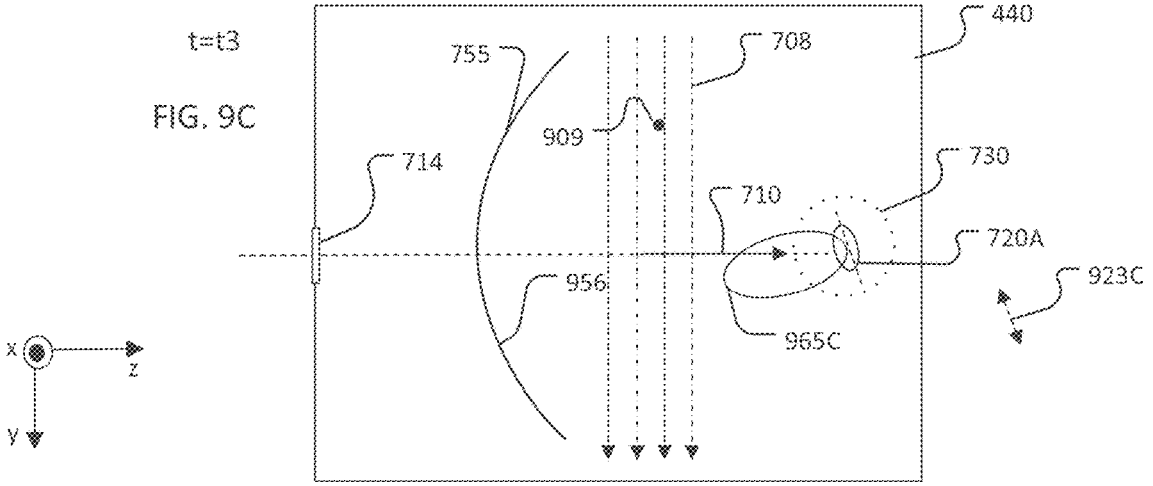

FIGS. 9A-9C are an example of using the process 800 to protect the fluid 708 (by ensuring that the fluid 708 remains in its intended flow configuration) and the optical element 755 by varying the position of the target 720. Although the process 800 can be used to protect any object in a vacuum chamber from the effects of plasma, the process 800 is discussed with respect to FIGS. 9A-9C for purposes of illustration.

A first target is provided to an interior of a vacuum chamber (810). Referring also to FIG. 9A, at the time t1, the target 720A is provided to the target region 730. The target 720A is an instance of the target 720 (FIG. 7A). The target 720A is an example of a first target. The target 720A includes target material arranged in a geometric distribution. The target material emits EUV light when in a plasma state, and also emits particles and/or radiation other than EUV light. The geometric distribution of target material in the target 720A has a first extent in a first direction, and a second extent in a second direction, which is perpendicular to the first direction. The first and second extents can be different. Referring to FIG. 9A, the target 720A has an elliptical cross-section in the y-z plane, and the larger of the first and second extent is along a direction 923A. As discussed below, the instances 720B and 720C of the target 720 at the later times of t2 and t3 (FIGS. 9B and 9C, respectively) have a different position than the instance 720A at the time t1 (FIG. 9A). The targets 720B and 720C have substantially the same geometric distribution of target material as the target 720A. However, the position of the targets 720A, 720B, 720C is different. As shown in FIG. 9B, at the time t2, the target 720B has the larger extent along a direction 923B, which is different from the direction 923A. At the time t3 (FIG. 9C), the target 720C has the larger extent along a direction 923C, which is different from 923A and 923B.

Figure 10A:
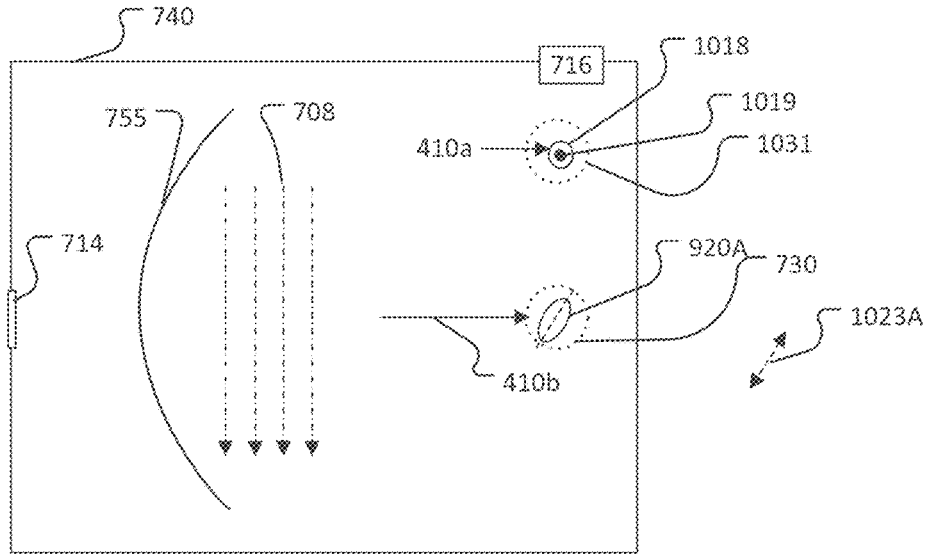
FIGS. 10A and 10B are block diagrams of an exemplary vacuum chamber that includes a target that has a position that varies with time.
Figure 10B:
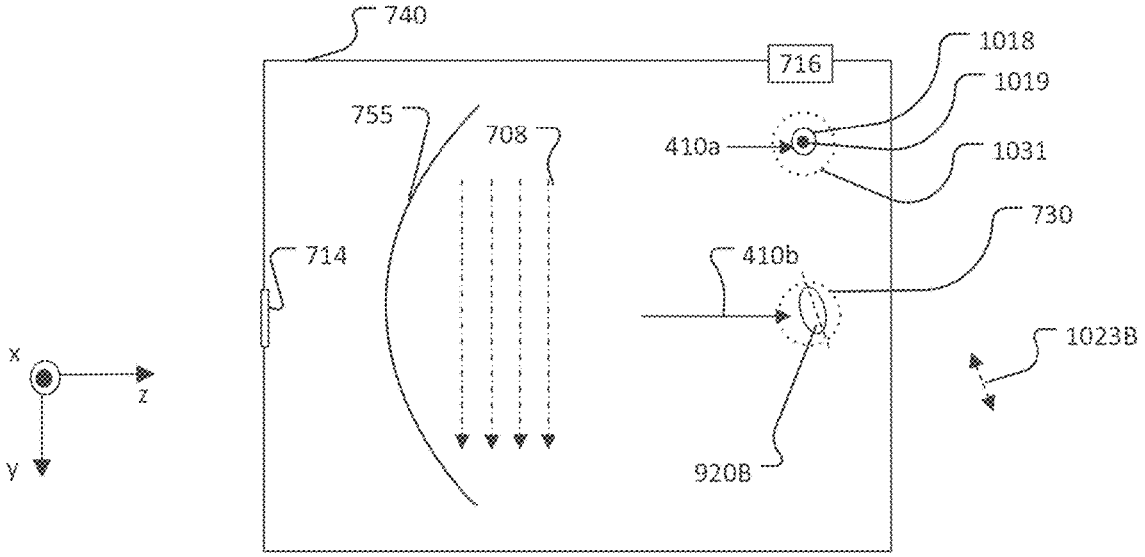

Providing any of the targets 720A, 720B, 720C to the target region 730 can include shaping, positioning, and/or orienting the target prior to the target reaching the target region 730. For example, and referring also to FIGS. 10A, and 10B, the target material supply apparatus 716 can provide an initial target 1018 to an initial target region 1031. In the example of FIGS. 10A and 10B, the initial target region 1031 is between the target region 730 and the target material supply apparatus 716. In the example of FIG. 10A, a target 920A is formed. In the example of FIG. 10B, a target 920B is formed. The target 920A and 920B are similar but are positioned differently in the vacuum chamber, as discussed below.

Referring to FIG. 10A, the control system 470 causes a pulse of the first optical beam 410*a* to propagate toward the initial target region 1031. The control system 470 causes the pulse of the first optical beam 410*a* to be emitted at a time such that the first optical beam 410*a* arrives in the initial target region 1031 when the initial target 1018 is in the initial target region 1031 but positioned such that the first light beam 410*a* strikes the initial target above (displaced in the −y direction) the center of mass 1019. For example, the control system 470 may receive a representation of the interior of the vacuum chamber 740 from the sensor 448 (FIG. 4) and detect that a the initial target 1018 is near or in the initial target region 1031 and then cause the emission of the pulse of the first light beam 410*a* based on the detection such that the first light beam 410*a* is displaced in the −y direction relative to the center of mass 1019. The initial target 1018 expands to form first and second extents along perpendicular directions, and the larger of these two extents extends in the direction 1023A.

Referring to FIG. 10B, to change the position of the next target (a target that arrives in the initial target region 1031 at a later time), the control system 400 causes another pulse of the first optical beam 410*a* to be emitted from the light-generation module 480 at a time such that the first light beam 410*a* reaches the initial target region 1031 when the next initial target 1018 is in the region 1031 and positioned within the region 1031 such that the first light beam 410*a* strikes the initial target 1018 below (displaced in the y direction) the center of mass 1019. For example, the control system 470 may receive a representation of the interior of the vacuum chamber 740 from the sensor 448 (FIG. 4) and detect that the next initial target 1018 is near or in the initial target region 1031 and then cause the emission of the pulse of the first light beam 410*a* based on the detection such that the first light beam 410*a* is displaced in the y direction relative to the center of mass 1019. The next initial target 1018 expands to form first and second extents along perpendicular directions, and the larger of these two extents extends in the direction 1023B, which is different from the direction 1023A.

As compared to a light beam that strikes the initial target 1018 at the center of mass 1019, the control system 470 causes the light beam 410*a* or a pulse of the light beam 410*a* to arrive earlier to orient the larger extent of the target 920A along the direction 1023A (FIG. 10A) and to arrive later to orient the larger extent of the target 920B along the direction 1023B (FIG. 10B).

Thus, a target can be positioned by irradiating an initial target with a light beam with a timing that is controlled with the control system 470 prior to the target arriving in the target is region 730. In other implementations, the target can be positioned by changing the direction of propagation of the first light beam 410*a*. Additionally, in some implementations, the target can be provided to the target region 730 at a particular orientation (and the orientation can be varied from target-to-target) without the use of an initial target. For example, the target can be oriented through manipulation of the target material supply apparatus 716 and/or formed prior to being released from the target material supply apparatus 716.

Returning to FIGS. 8 and 9A, the light beam 710 is directed to the target region 730 (820). The light beam 710 has an energy sufficient to convert at least some of the target material in the target 720A to plasma. The plasma emits EUV light and also emits particles and/or radiation. The particles and/or radiation are emitted non-isotropically and are primarily emitted in a particular direction, toward a first peak 965A (FIG. 9A).

The first and second extents of the first target are positioned relative to a separate and distinct object in the vacuum chamber. For example, the target 720A of FIG. 9A has an elliptically shaped cross-section in the y-z plane and a maximum extent in the y-z plane in a direction 923A. The direction 923A (and a direction perpendicular to the direction 923A) forms an angle with respect to a surface normal of the window 714. In this way, the target 720A can be considered to be positioned or angled relative to the window 714. In another example, the direction 923A forms an angle relative to a space in the fluid 408 that is marked with the label 909. In yet another example, the direction 923A forms an angle with a surface normal at a region (marked with the label 956) on the optical element 755

As discussed above, the location of the peak 965A depends on the position of the target 920. Thus, the location of the peak 965B can be changed by changing the position of the target 920.

A second target is provided to the interior of the vacuum chamber 740 (830). The second target has a different position than the first target. Referring to FIG. 9B, at the time t2, the target 720B has an elliptical cross-section in the y-z plane, with the ellipse having a major axis. The largest extent of the second target in the y-z plane is along the major axis in a direction 923B. The direction 923B is different from the direction 923A. Thus, as compared to the first target, the second target is positioned differently relative to the window 714 and other objects in the vacuum chamber 740. In this example, the direction 923B is perpendicular to the z direction. The target 720B can be positioned to have the larger extent in the direction 923B by, for example, controlling the light beam control module 471 to emit the first light beam 410*a* at a time such that the first light beam 410*a* strikes an initial target (such as the initial target 1018 of FIGS. 10A and 10B) at its center of mass.

The light beam 710 is directed toward the target region 730 to form a second plasma from the second target (840). Because the position of the second target is different from the position of the first target, the second plasma primarily emits particles and/or radiation toward a peak 965B, which is in a different location than the peak 965A.

Thus, by controlling the position of the target over time with the control system 470, the direction in which particles and radiation are emitted from the plasma can also be controlled.

The process 800 can be applied to more than two targets, and the process 800 can be applied to determine the position of any or all of the targets that enter the target region 730 during operation of the vacuum chamber 740. For example, as shown in FIG. 9C, the target 720C in the target region 730 at the time t3 has a different position than the targets 720A and 720B. Plasma formed from the target 720C at the time t3 emits particles and/or radiation primarily toward a peak 965C. The peak 965C is at a different location in the vacuum chamber 740 than the peaks 965A and 965B. Thus, continuing to vary the target orientation or position over time can further spread out the heating effects of the plasma. For example, the peak 965A is pointed toward the region of the fluid 708 labeled 909, but the peaks 965B and 965C are not. In other example, the peak 965C is pointed at the region 956 on the optical element 755, but the peaks 965A and 965B are not. In this way, the region 956 may avoid becoming contaminated.

The process 800 can be used to continuously change the position of targets that enter the target region 730. For example, the position of any target in the target region 730 can be different than the position of the immediately preceding and/or immediately subsequent targets. In other examples, the position of each target that reaches the target region 730 is not necessarily different. In these examples, the position of any target in the target region 730 can be different from the position of at least one other target in the target region 730. Further, the change in position can be incremental with the angle relative to a particular object increasing or decreasing with each change until a maximum and/or minimum angle is reached. In other implementations, the change in position among the various targets reaching the target region 730 may be a random or pseudo-random amount of angle variation.

Furthermore, and referring to FIG. 10C, the position of the targets may be changed such that the direction along which the peak directional flux is emitted sweeps out a three-dimensional region in the vacuum vessel 740. FIG. 10C shows a view of the optical element 755 looking from the target region 730 (looking in the direction), with the direction along which the peak directional flux is emitted over time represented by a path 1065. Although the directional flux did not necessarily reach the optical element 755, the path 1065 illustrates that the targets that come into the target region 730 over time can have different positions from each other and the different positions can result in the peak emission direction sweeping out a three-dimensional region in the vacuum vessel 740.

Additionally, the process 800 can change the position of targets that enter the target region 730 at a rate that does not necessarily result in the positioning of any target being different than the positioning of the immediately preceding and/or immediately subsequent targets, but that changes the position of the targets that enter the target region 730 at a rate that prevents damage to objects in the vacuum chamber based on the operating conditions or desired operating parameters.

Figure 11:
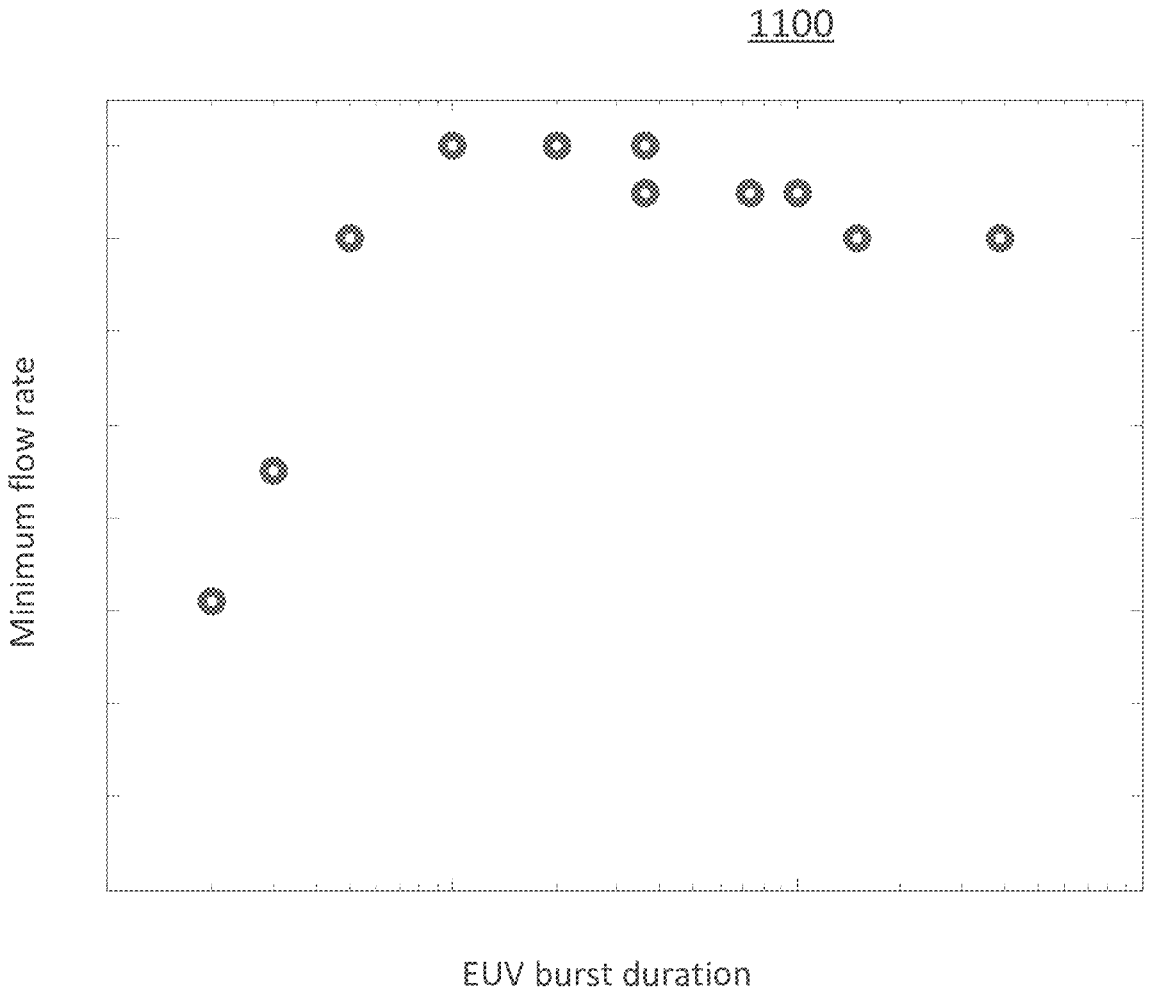
FIG. 11 is a plot of exemplary data relating minimum fluid flow and EUV burst duration.

For example, the amount of fluid 708 and the flow rate of the fluid 708 needed to protect the optical element 755 from high-energy ion deposits depends on the duration of the plasma generation in the vacuum chamber. FIG. 11 is an example plot 1100 of the relationship between minimum acceptable fluid flow and EUV emission duration. The EUV emission duration also can be referred to as an EUV burst duration, and the EUV burst can be formed from converting a plurality of successive targets into plasma. The y-axis of the plot 1100 is the fluid flow rate, and the x-axis of the plot 1100 is the duration of an EUV light burst generated in the vacuum chamber 740. The x-axis of the plot 1100 is in log scale.

Data relating the minimum flow rate to the EUV emission duration (such as data that forms a plot such as the plot 1100) may be stored on the electronic storage 473 of the control system 470 and used by the control system 470 to determine how often the position of the target 720 should be changed to minimize consumption of the fluid 708 while still protecting the objects in the vacuum chamber 740. For example, the data used for the plot 1100 indicate a minimum flow rate to prevent contamination in a system that uses an EUV burst having various durations. The minimum flow rate needed may be reduced by changing the position of one or more of the targets that are used to produce the EUV burst relative to the position of the other targets that are used to produce the EUV burst. The plot 1100 may be used to determine how often the target in the target region should be repositioned to achieve the desired minimum flow rate. For example, if the desired minimum flow rate corresponds with a lower EUV burst duration than the source is operating at, the targets arriving in the target region may be repositioned such that the directional flux of particles and/or radiation produced by any individual target or collection of targets is directed into a particular region of the vacuum chamber for an amount of time that is the same as that lower EUV burst duration. In this way, the EUV burst duration experienced by any particular region of the vacuum chamber may be reduced and the minimum flow rate of the fluid 708 also may be reduced.

FIG. 11 shows an example relationship between the flow rate of the fluid 708 and the EUV burst duration. Other properties of the fluid 708, such as, for example, pressure and/or density, may vary with the EUV burst duration. In this way, the process 800 also can be used to reduce the amount of fluid 708 that is needed to protect the optical element 755.

Figure 12:
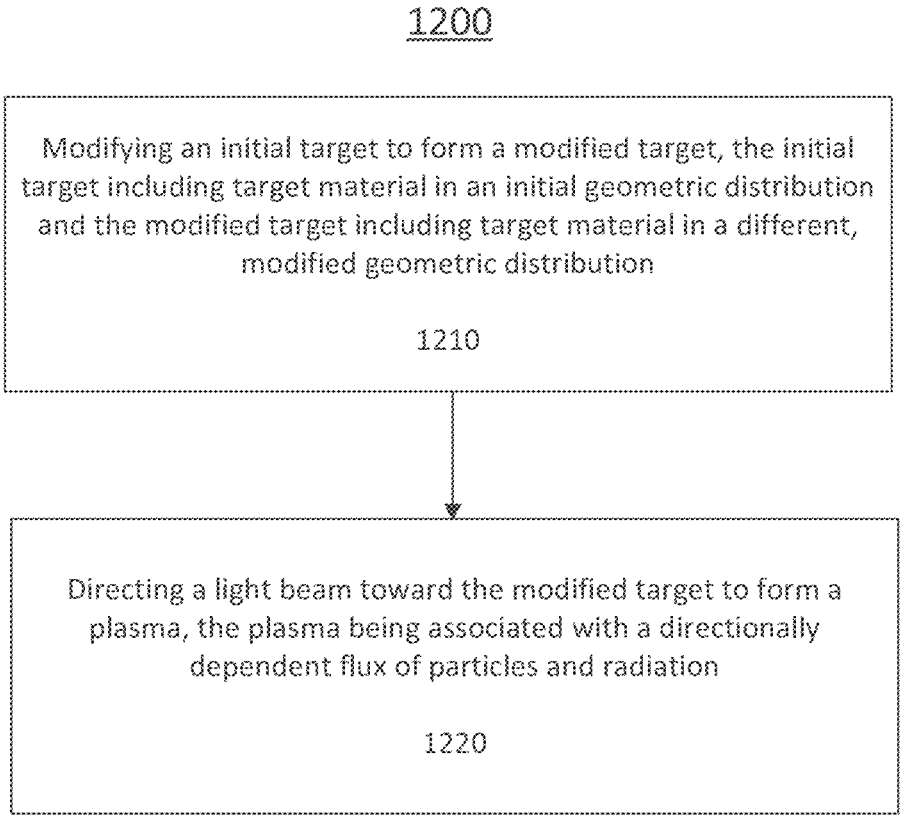
FIG. 12 is a flow chart of an exemplary process for protecting an object in a vacuum chamber.

Referring to FIG. 12, a flow chart of an example process 1200 is shown. The process 1200 positions a target in a vacuum chamber such that the effects of plasma on an object in the vacuum chamber are reduced or eliminated. The process 1200 can be performed by the control system 470.

An initial target is modified to form a modified target (1210). The modified target and the initial target include target material, but the geometric distribution of the target material is different than that of the modified target. The initial target can be, for example, an initial target such as the initial targets 618 (FIG. 6C) or 1018 (FIGS. 10A and 10B). The modified target can be a disk-shaped target formed by irradiating the initial target with a pre-pulse (such as the pre-pulse 606 of FIGS. 6A-6B) or with a light beam, such as the first light beam 410*a* of FIG. 4, that does not necessarily convert the target material in the initial target to a plasma that emits EUV but does condition the initial target.

The modified target may be positioned relative to a separate and distinct object. The interaction between the initial target and a light beam can determine the position of the modified target. For example, as discussed above with respect to FIGS. 6A-6C, FIG. 8, and FIGS. 10A and 10B, a disk-shaped target with a particular position can be formed by directing a light beam to a particular part of the initial target. The separate and distinct object is any object in a vacuum chamber. For example, the separate and distinct object may be a buffer fluid, a target in a stream of targets, and/or an optical element.

A light beam is directed toward the modified target (1220). The light beam may be an amplified light beam, such as the second light beam 410*b* (FIG. 4). The light beam has an energy sufficient to convert at least some of the target material in the modified target to plasma that emits EUV light. The plasma is also associated with a directionally dependent flux of particles and/or radiation, and the directionally dependent flux has a maximum (a location, region, or direction into which the highest portion of the particles and/or radiation flow). The maximum is referred to as the peak direction, and the peak direction depends on the position of the modified target. The particles and radiation may be preferentially emitted from the heated side of the modified target, which is the side that receives the light beam first. Thus, for a disk-shaped target that receives the light beam at one of the flat faces of the disk, the peak direction is in a direction that is normal to the face of the disk that receives the light beam. The modified target may be positioned such that the effect of the plasma on the object is reduced. For example, orienting the modified target such that the heating side of the target points away from the object to be protected will result in the fewest possible high-energy ions being directed toward the object.

The process 1200 can be performed for a single target or repeatedly. For implementations in which the process 1200 is performed repeatedly, the position of the modified target for any particular instance of the process 1200 can be different from positions of previous or subsequent modified targets.

Figure 13A:
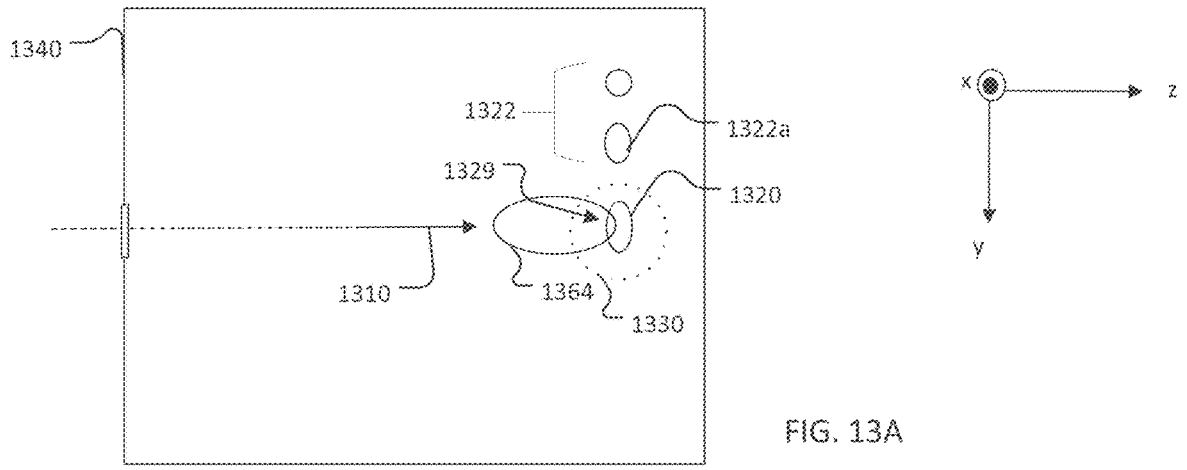
FIGS. 13A-13C are block diagrams of an exemplary vacuum chamber that includes a target that has a position and/or a target path that varies with time.
Figure 13B:
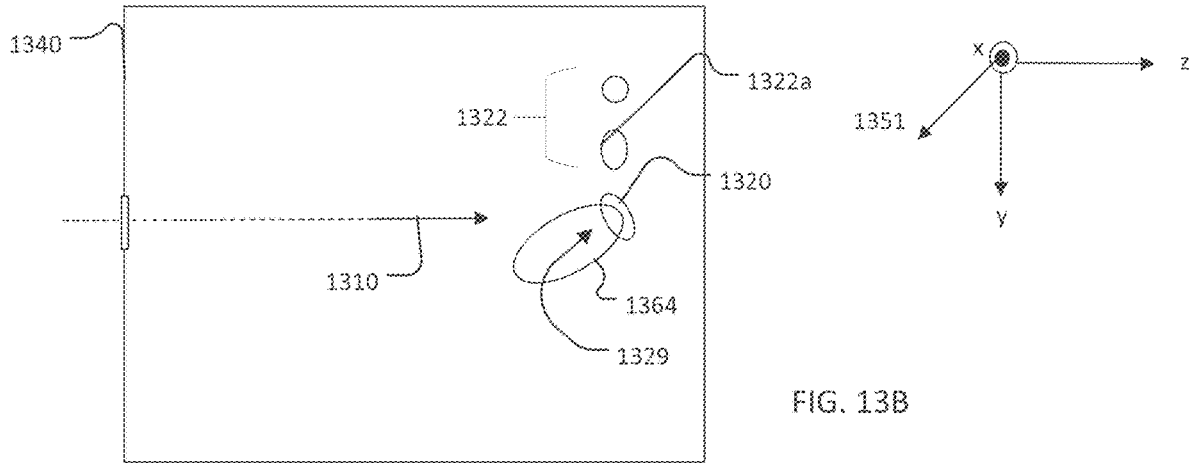
Figure 13C:
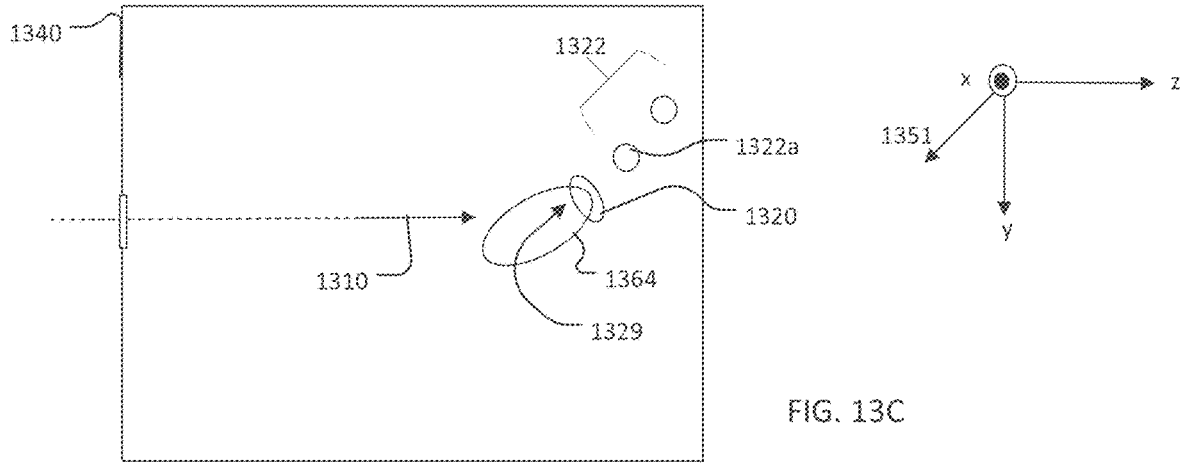

Referring to FIGS. 13A-13C, the process 1200 may be used to protect targets in a stream of targets from the effects of the plasma. FIGS. 13A-13B, which are block diagrams of an interior of a vacuum chamber 1340, illustrate how a target in the vacuum chamber may be protected from the effects of plasma. FIG. 13A shows a stream 1322 of targets, which travels in the vacuum chamber in a direction y toward a target region 1330. The direction along which the stream 1322 travels may be referred to as the target trajectory or the target path. A light beam 1310 propagates in a direction z toward the target region 1330. The target 1320 is the target in the stream 1322 in the target region 1330. The interaction between the light beam 1310 and the target 1320 converts the target material in the target 1320 to plasma that emits EUV light.

Additionally, the plasma emits a directionally dependent flux of particles and/or radiation, represented by the profile 1364. In the example of FIG. 13A, profile 1364 shows that the particles and/or radiation are primarily emitted in a direction opposite to the z direction, and the greatest effect of the plasma is in this direction. However, the plasma also has an impact on objects that are displaced in the y direction, including a target 1322*a*, which is the target in the stream 1322 that is closest to (but outside of) the target region 1330 when the plasma is formed. In other words, in the example of FIG. 13A, the target 1322*a* is the next incoming target or the target that will be in the target region 1330 after the target 1320 is consumed to produce plasma.

The effect of the plasma on the target 1322*a* may be direct, such as the target 1322*a* experiencing ablation from the radiation in the directionally dependent flux. Such ablation may slow the target and/or change the shape of the target. The radiation from the plasma can apply a force to the target 1322*a*, resulting in the target 1322*a* reaching the target region 1330 later than expected. The light beam 1310 may be a pulsed light beam. Thus, if the target 1322*a* reaches the target region 1330 later than expected, the light beam 1310 and the target may miss each other and no plasma is produced. Additionally, the force of the plasma radiation may change the shape of the target 1322*a* unexpectedly and may interfere with intentional shape changes that condition the targets in the stream 1322 prior to reaching the target region 1330 to increase plasma production.

The effect of the plasma on the target 1322*a* also may be indirect. For example, a buffer fluid may flow in the vacuum chamber 1340, and the directionally dependent flux may heat the fluid, and the heating of the fluid may change the trajectory of the targets (such as discussed with respect to FIGS. 7A and 7B). Indirect effects also may interfere with the proper operation of the light source.

The effects of the plasma on the target 1322*a* can be reduced by orienting a heating side 1329 of the target 1320 away from the target 1322*a*. The heating side 1329 of the target 1320 is the side of the target 1320 that initially receives the light beam 1310, and the particles and/or radiation are emitted primarily from the heating side 1329 and in a direction that is normal to the target material distribution at the heating side 1329. The portion P of the radiation emitted by the plasma at a particular angle relative to the target 1320 may approximate the relationship of Equation 1:

$$P(\theta)=1-\cos^2(\theta) \quad (1),$$

where n is an integer number, and θ is the angle between the normal to the target on the heating side 1329 and the direction of the target trajectory between the centers of mass of the target 1320 and the target 1322*a*. Other angular distributions of the radiation are possible.

Referring to FIG. 13B, the position of the target 1320 is changed as compared to the position in FIG. 13A such that the heating side 1329 points away from the target 1322*a*. As a result of this positioning, the particles and/or radiation are emitted in a direction 1351, away from the target 1322*a*. Referring to FIG. 13C, the effect on the target 1322*a* is further reduced by positioning the heating side 1329 of the target 1320 away from the target 1322*a* and positioning the path of the target stream 1322 such that the target 1322*a* is located in a region that has the fewest particles and/or the least radiation from the plasma. In the example of FIG. 13C, this region is a region that is in a direction opposite the direction 1351 (behind the target 1320), and the targets in the target stream 1322 travels along the direction 1351.

Thus, the effects of the plasma on other targets in the vacuum chamber may be reduced by orienting the target and/or positioning of the target path.

Figure 15A:
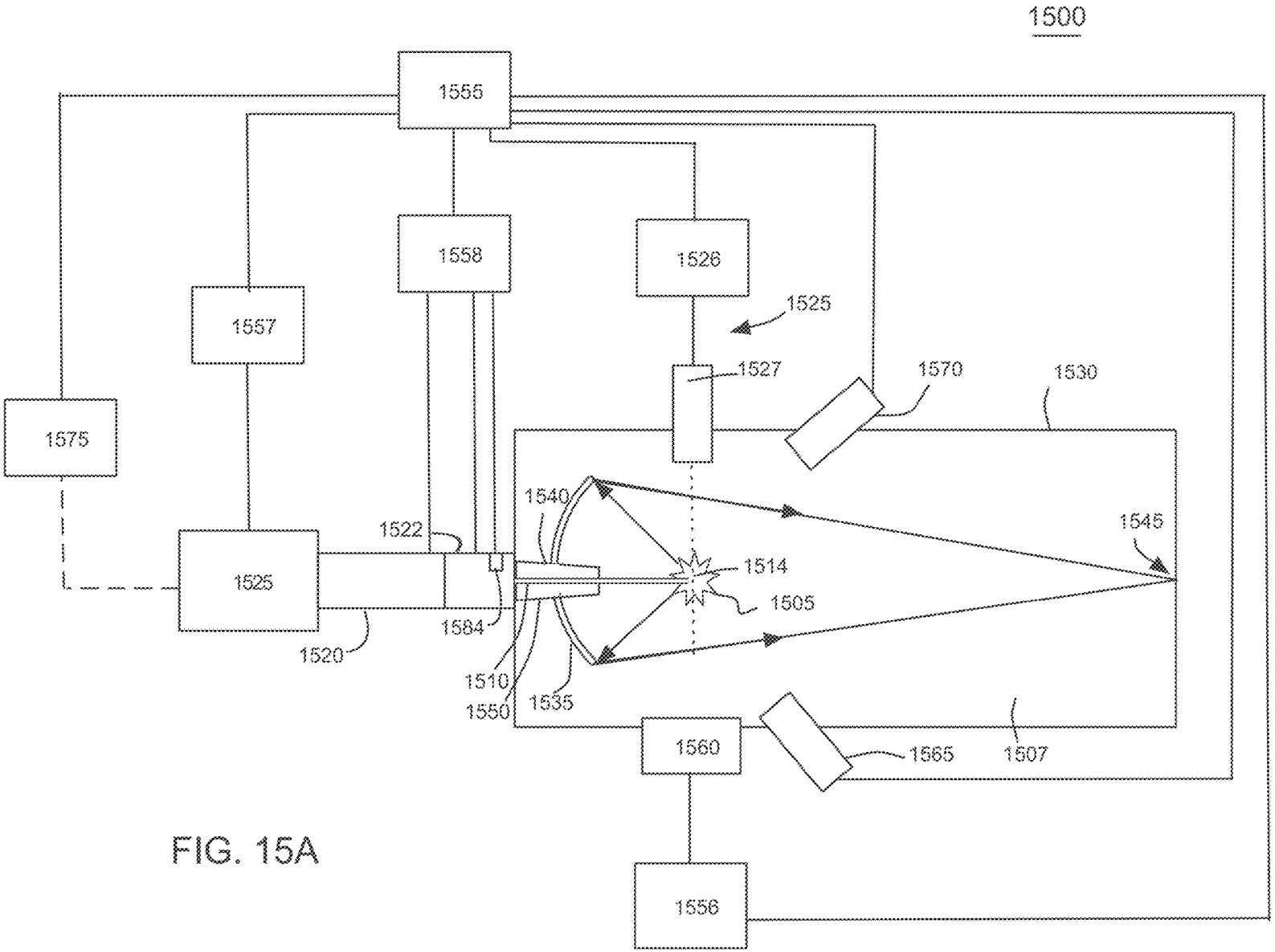
FIG. 15A is a block diagram of an exemplary optical lithography system that includes an EUV light source.
Figure 15B:
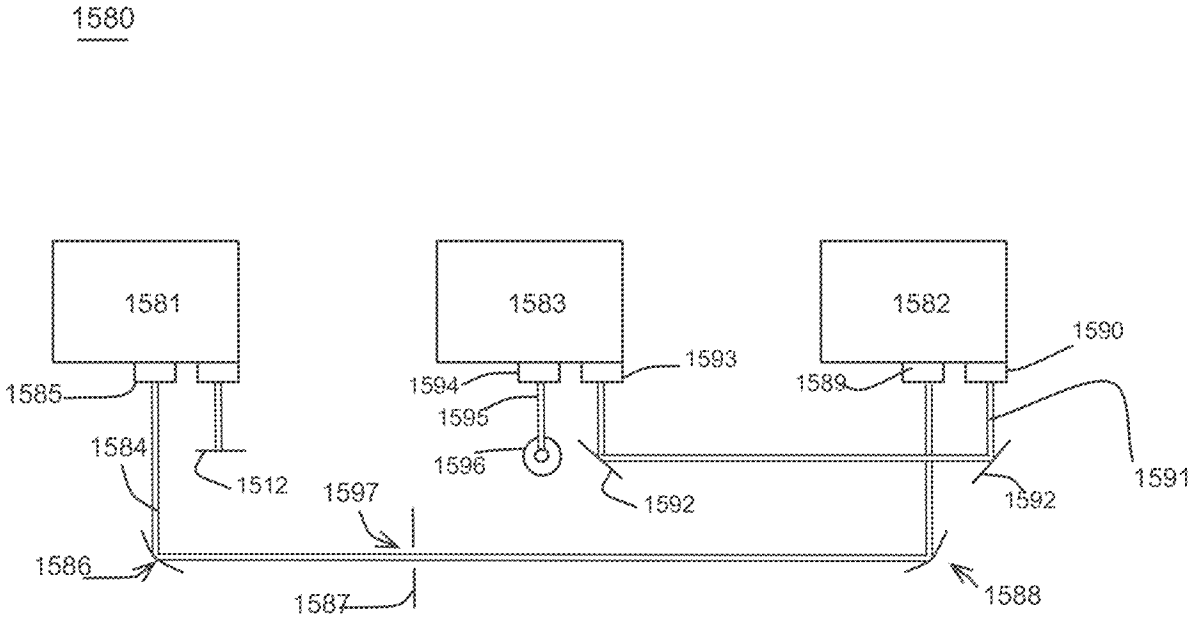
FIG. 15B is a block diagram of an optical amplifier system that can be used in the EUV light source of FIG. 15A.

FIGS. 14, 15A, and 15B are additional examples of systems in which the processes 800 and 1200 can be performed.

Referring to FIG. 14, a block diagram of an exemplary optical imaging system 1400 is shown. The optical imaging system 1400 includes an LPP EUV light source 1402 that provides light to a lithography tool 1470. The light source 1402 can be similar to, and/or include some or all of the components of, the light source 101 of FIG. 1.

The system 1400 includes an optical source such as a drive laser system 1405, an optical element 1422, a pre-pulse source 1443, a focusing assembly 1442, and a vacuum chamber 1440. The drive laser system 1405 produces an amplified light beam 1410. The amplified light beam 1410 has energy sufficient to convert target material in a target 1420 into plasma that emits EUV light. Any of the targets discussed above can be used as the target 1420.

The pre-pulse source 1443 emits pulses of radiation 1417. The pulses of radiation can be used as the pre-pulse 606 (FIG. 6A-6C). The pre-pulse source 1443 can be, for example, a Q-switched Nd:YAG laser that operates at a 50 kHz repetition rate, and the pulses of radiation 1417 can be pulses from the Nd:YAG laser that have a wavelength of 1.06 μm. The repetition rate of the pre-pulse source 1443 indicates how often the pre-pulse source 1443 produces a pulse of radiation. For the example where the pre-pulse source 1443 has a 50 kHz repetition rate, a pulse of radiation 1417 is emitted every 20 microseconds (μs).

Other sources can be used as the pre-pulse source 1443. For example, the pre-pulse source 1443 can be any rare-earth-doped solid state laser other that an Nd:YAG, such as an erbium-doped fiber (Er:glass) laser. In another example, the pre-pulse source can be a carbon dioxide laser that produces pulses having a wavelength of 10.6 μm. The pre-pulse source 1443 can be any other radiation or light source that produces light pulses that have an energy and wavelength used for the pre-pulses discussed above.

The optical element 1422 directs the amplified light beam 1410 and the pulses of radiation 1417 from the pre-pulse source 1443 to the chamber 1440. The optical element 1422 is any element that can direct the amplified light beam 1410 and the pulses of radiation 1417 along similar or the same paths. In the example shown in FIG. 14, the optical element 1422 is a dichroic beamsplitter that receives the amplified light beam 1410 and reflects it toward the chamber 1440. The optical element 1422 receives the pulses of radiation 1417 and transmits the pulses toward the chamber 1440. The dichroic beamsplitter has a coating that reflects the wavelength(s) of the amplified light beam 1410 and transmits the wavelength(s) of the pulses of radiation 1417. The dichroic beamsplitter can be made of, for example, diamond.

In other implementations, the optical element 1422 is a mirror that defines an aperture (not shown). In this implementation, the amplified light beam 1410 is reflected from the mirror surface and directed toward the chamber 1440, and the pulses of radiation pass through the aperture and propagate toward the chamber 1440.

In still other implementations, a wedge-shaped optic (for example, a prism) can be used to separate the main pulse 1410 and the pre-pulse 1417 into different angles, according to their wavelengths. The wedge-shaped optic can be used in addition to the optical element 1422, or it can be used as the optical element 1422. The wedge-shaped optic can be positioned just upstream (in the direction) of the focusing assembly 1442.

Additionally, the pulses 1417 can be delivered to the chamber 1440 in other ways. For example, the pulses 1417 can travel through optical fibers that deliver the pulses 1417 to the chamber 1440 and/or the focusing assembly 1442 without the use of the optical element 1422 or other directing elements. In these implementations, the fibers bring the pulses of radiation 1417 directly to an interior of the chamber 1440 through an opening formed in a wall of the chamber 1440.

The amplified light beam 1410 is reflected from the optical element 1422 and propagates through the focusing assembly 1442. The focusing assembly 1442 focuses the amplified light beam 1410 at a focal plane 1446, which may or may not coincide with a target region 1430. The pulses of radiation 1417 pass through the optical element 1422 and are directed through the focusing assembly 1442 to the chamber 1440. The amplified light beam 1410 and the pulses of radiation 1417, are directed to different locations along the y direction in the chamber 1440 and arrive in the chamber 1440 at different times.

In the example shown in FIG. 14, a single block represents the pre-pulse source 1443. However, the pre-pulse source 1443 can be a single light source or a plurality of light sources. For example, two separate sources can be used to generate a plurality of pre-pulses. The two separate sources can be different types of sources that produce pulses of radiation having different wavelengths and energies. For example, one of the pre-pulses can have a wavelength of 10.6 μm and be generated by a $CO_2$ laser, and the other pre-pulse can have a wavelength of 1.06 μm and be generated by a rare-earth-doped solid state laser.

In some implementations, the pre-pulses 1417 and the amplified light beam 1410 can be generated by the same source. For example, the pre-pulse of radiation 1417 can be generated by the drive laser system 1405. In this example, the drive laser system can include two $CO_2$ seed laser subsystems and one amplifier. One of the seed laser subsystems can produce an amplified light beam having a wavelength of 10.26 μm, and the other seed laser subsystem can produce an amplified light beam having a wavelength of 10.59 μm. These two wavelengths can come from different lines of the $CO_2$ laser. In other examples, other lines of the $CO_2$ laser can be used to generate the two amplified light beams. Both amplified light beams from the two seed laser subsystems are amplified in the same power amplifier chain and then angularly dispersed to reach different locations within the chamber 1440. The amplified light beam with the wavelength of 10.26 μm can be used as the pre-pulse 1417, and the amplified light beam with the wavelength of 10.59 μm can be used as the amplified light beam 1410. In implementations that employ a plurality of pre-pulses, three seed lasers can be used, one of which is used to generate each of the amplified light beam 1410, a first pre-pulse, and a second, separate pre-pulse.

The amplified light beam 1410 and the pre-pulse of radiation 1417 can all be amplified in the same optical amplifier. For example, the three or more power amplifiers can be used to amplify the amplified light beam 1410 and the pre-pulse 1417.

Referring to FIG. 15A, an LPP EUV light source 1500 is shown. The EUV light source 1500 can be used with the light sources, processes, and vacuum chambers discussed above. The LPP EUV light source 1500 is formed by irradiating a target mixture 1514 at a target region 1505 with an amplified light beam 1510 that travels along a beam path toward the target mixture 1514. The target region 1505, which is also referred to as the irradiation site, is within an interior 1507 of a vacuum chamber 1530. When the amplified light beam 1510 strikes the target mixture 1514, a target material within the target mixture 1514 is converted into a plasma state that has an element with an emission line in the EUV range. The created plasma has certain characteristics that depend on the composition of the target material within the target mixture 1514. These characteristics can include the wavelength of the EUV light produced by the plasma and the type and amount of debris released from the plasma.

The light source 1500 also includes a target material delivery system 1525 that delivers, controls, and directs the target mixture 1514 in the form of liquid droplets, a liquid stream, solid particles or clusters, solid particles contained within liquid droplets or solid particles contained within a liquid stream. The target mixture 1514 includes the target material such as, for example, water, tin, lithium, xenon, or any material that, when converted to a plasma state, has an emission line in the EUV range. For example, the element tin can be used as pure tin (Sn); as a tin compound, for example, $SnBr_4$, $SnBr_2$, $SnH_4$; as a tin alloy, for example, tin-gallium alloys, tin-indium alloys, tin-indium-gallium alloys, or any combination of these alloys. The target mixture 1514 can also include impurities such as non-target particles. Thus, in the situation in which there are no impurities, the target mixture 1514 is made up of only the target material. The target mixture 1514 is delivered by the target material delivery system 1525 into the interior 1507 of the chamber 1530 and to the target region 1505.

The light source 1500 includes a drive laser system 1515 that produces the amplified light beam 1510 due to a population inversion within the gain medium or mediums of the laser system 1515. The light source 1500 includes a beam delivery system between the laser system 1515 and the target region 1505, the beam delivery system including a beam transport system 1520 and a focus assembly 1522. The beam transport system 1520 receives the amplified light beam 1510 from the laser system 1515, and steers and modifies the amplified light beam 1510 as needed and outputs the amplified light beam 1510 to the focus assembly 1522. The focus assembly 1522 receives the amplified light beam 1510 and focuses the beam 1510 to the target region 1505.

In some implementations, the laser system 1515 can include one or more optical amplifiers, lasers, and/or lamps for providing one or more main pulses and, in some cases, one or more pre-pulses. Each optical amplifier includes a gain medium capable of optically amplifying the desired wavelength at a high gain, an excitation source, and internal optics. The optical amplifier may or may not have laser mirrors or other feedback devices that form a laser cavity. Thus, the laser system 1515 produces an amplified light beam 1510 due to the population inversion in the gain media of the laser amplifiers even if there is no laser cavity. Moreover, the laser system 1515 can produce an amplified light beam 1510 that is a coherent laser beam if there is a laser cavity to provide enough feedback to the laser system 1515. The term "amplified light beam" encompasses one or more of: light from the laser system 1515 that is merely amplified but not necessarily a coherent laser oscillation and light from the laser system 1515 that is amplified and is also a coherent laser oscillation.

The optical amplifiers in the laser system 1515 can include as a gain medium a filling gas that includes $CO_2$ and can amplify light at a wavelength of between about 9100 and about 11000 nm, and in particular, at about 10600 nm, at a gain greater than or equal to 1500. Suitable amplifiers and lasers for use in the laser system 1515 can include a pulsed laser device, for example, a pulsed, gas-discharge $CO_2$ laser device producing radiation at about 9300 nm or about 10600 nm, for example, with DC or RF excitation, operating at relatively high power, for example, 10 kW or higher and high pulse repetition rate, for example, 40 kHz or more. The optical amplifiers in the laser system 1515 can also include a cooling system such as water that can be used when operating the laser system 1515 at higher powers.

FIG. 15B shows a block diagram of an example drive laser system 1580. The drive laser system 1580 can be used as part of the drive laser system 1515 in the source 1500. The drive laser system 1580 includes three power amplifiers 1581, 1582, and 1583. Any or all of the power amplifiers 1581, 1582, and 1583 can include internal optical elements (not shown).

Light 1584 exits from the power amplifier 1581 through an output window 1585 and is reflected off a curved mirror 1586. After reflection, the light 1584 passes through a spatial filter 1587, is reflected off of a curved mirror 1588, and enters the power amplifier 1582 through an input window 1589. The light 1584 is amplified in the power amplifier 1582 and redirected out of the power amplifier 1582 through an output window 1590 as light 1591. The light 1591 is directed toward the amplifier 1583 with a fold mirror 1592 and enters the amplifier 1583 through an input window 1593. The amplifier 1583 amplifies the light 1591 and directs the light 1591 out of the amplifier 1583 through an output window 1594 as an output beam 1595. A fold mirror 1596 directs the output beam 1595 upward (out of the page) and toward the beam transport system 1520 (FIG. 15A).

Referring again to FIG. 15B, the spatial filter 1587 defines an aperture 1597, which can be, for example, a circle having a diameter between about 2.2 mm and 3 mm. The curved mirrors 1586 and 1588 can be, for example, off-axis parabola mirrors with focal lengths of about 1.7 m and 2.3 m, respectively. The spatial filter 1587 can be positioned such that the aperture 1597 coincides with a focal point of the drive laser system 1580.

Referring again to FIG. 15A, the light source 1500 includes a collector mirror 1535 having an aperture 1540 to allow the amplified light beam 1510 to pass through and reach the target region 1505. The collector mirror 1535 can be, for example, an ellipsoidal mirror that has a primary focus at the target region 1505 and a secondary focus at an intermediate location 1545 (also called an intermediate focus) where the EUV light can be output from the light source 1500 and can be input to, for example, an integrated circuit lithography tool (not shown). The light source 1500 can also include an open-ended, hollow conical shroud 1550 (for example, a gas cone) that tapers toward the target region 1505 from the collector mirror 1535 to reduce the amount of plasma-generated debris that enters the focus assembly 1522 and/or the beam transport system 1520 while allowing the amplified light beam 1510 to reach the target region 1505. For this purpose, a gas flow can be provided in the shroud that is directed toward the target region 1505.

The light source 1500 can also include a master controller 1555 that is connected to a droplet position detection feedback system 1556, a laser control system 1557, and a beam control system 1558. The light source 1500 can include one or more target or droplet imagers 1560 that provide an output indicative of the position of a droplet, for example, relative to the target region 1505 and provide this output to the droplet position detection feedback system 1556, which can, for example, compute a droplet position and trajectory from which a droplet position error can be computed either on a droplet by droplet basis or on average. The droplet position detection feedback system 1556 thus provides the droplet position error as an input to the master controller 1555. The master controller 1555 can therefore provide a laser position, direction, and timing correction signal, for example, to the laser control system 1557 that can be used, for example, to control the laser timing circuit and/or to the beam control system 1558 to control an amplified light beam position and shaping of the beam transport system 1520 to change the location and/or focal power of the beam focal spot within the chamber 1530.

The target material delivery system 1525 includes a target material delivery control system 1526 that is operable, in response to a signal from the master controller 1555, for example, to modify the release point of the droplets as released by a target material supply apparatus 1527 to correct for errors in the droplets arriving at the desired target region 1505.

Additionally, the light source 1500 can include light source detectors 1565 and 1570 that measures one or more EUV light parameters, including but not limited to, pulse energy, energy distribution as a function of wavelength, energy within a particular band of wavelengths, energy outside of a particular band of wavelengths, and angular distribution of EUV intensity and/or average power. The light source detector 1565 generates a feedback signal for use by the master controller 1555. The feedback signal can be, for example, indicative of the errors in parameters such as the timing and focus of the laser pulses to properly intercept the droplets in the right place and time for effective and efficient EUV light production.

The light source 1500 can also include a guide laser 1575 that can be used to align various sections of the light source 1500 or to assist in steering the amplified light beam 1510 to the target region 1505. In connection with the guide laser 1575, the light source 1500 includes a metrology system 1524 that is placed within the focus assembly 1522 to sample a portion of light from the guide laser 1575 and the amplified light beam 1510. In other implementations, the metrology system 1524 is placed within the beam transport system 1520. The metrology system 1524 can include an optical element that samples or re-directs a subset of the light, such optical element being made out of any material that can withstand the powers of the guide laser beam and the amplified light beam 1510. A beam analysis system is formed from the metrology system 1524 and the master controller 1555 since the master controller 1555 analyzes the sampled light from the guide laser 1575 and uses this information to adjust components within the focus assembly 1522 through the beam control system 1558.

Thus, in summary, the light source 1500 produces an amplified light beam 1510 that is directed along the beam path to irradiate the target mixture 1514 at the target region 1505 to convert the target material within the mixture 1514 into plasma that emits light in the EUV range. The amplified light beam 1510 operates at a particular wavelength (that is also referred to as a drive laser wavelength) that is determined based on the design and properties of the laser system 1515. Additionally, the amplified light beam 1510 can be a laser beam when the target material provides enough feedback back into the laser system 1515 to produce coherent laser light or if the drive laser system 1515 includes suitable optical feedback to form a laser cavity.

Figure 16:
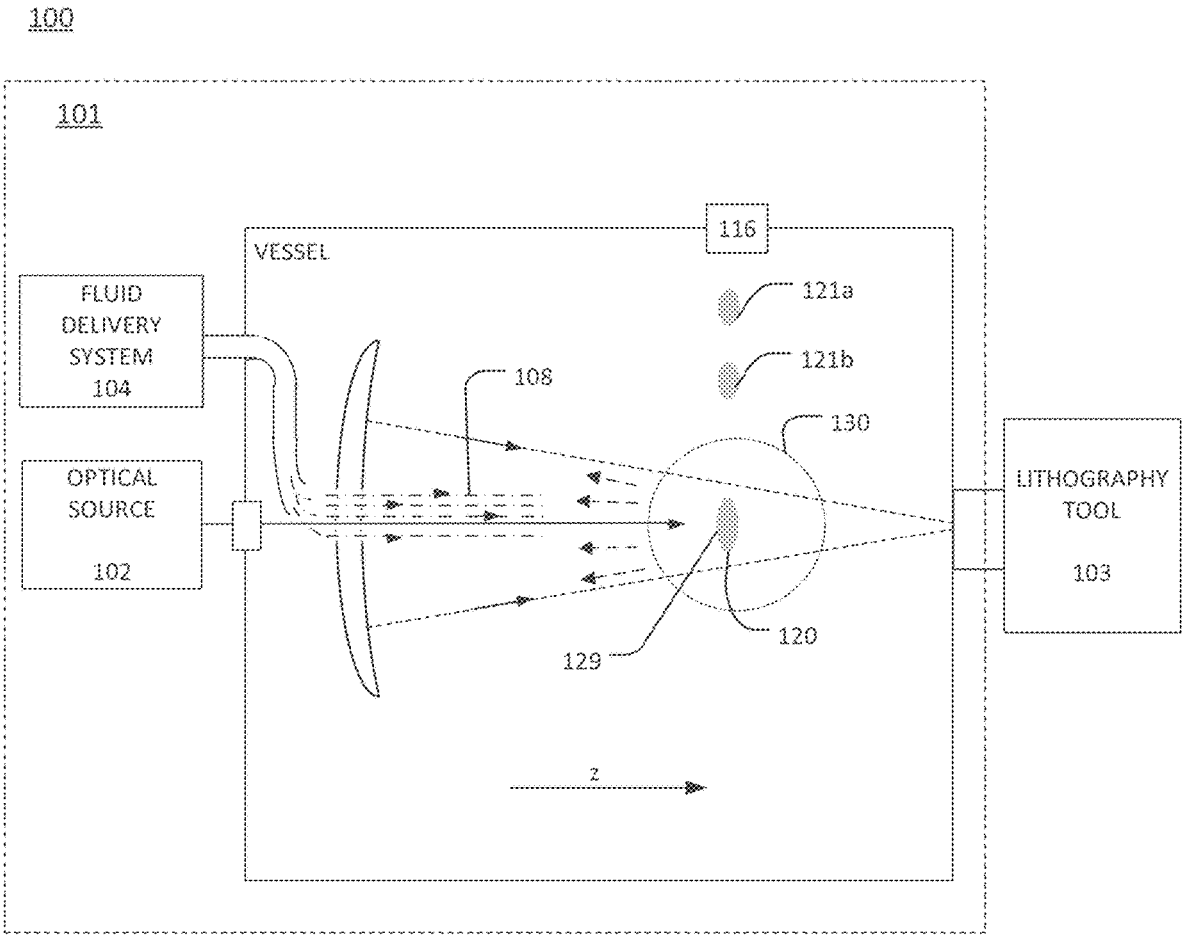
FIG. 16 is a block diagram of another implementation of the EUV light source of FIG. 1.

Other implementations are within the scope of the claims. For example, the fluid 108 and 708 is shown as flowing in the y direction and perpendicular to the direction of propagation of a light beam that converts target material to plasma. However, the fluid 108 and 708 may flow in any direction as determined by the flow configuration associated with a set of operating conditions. For example, referring to FIG. 16, an alternate implementation of the light source 101 is shown in which the fluid 108 of the vacuum chamber flows in the z direction. Additionally, any of the characteristics of the flow that are part of the flow configuration (including the direction of flow) can be intentionally changed during operation of the light source 101.

Additionally, although the examples of FIGS. 6A-6C and 10A and 10B show using a pre-pulse to initiate tilting of an initial target, as discussed above, a tilted target can be delivered to the target regions 130, 730, and/or 1330 with other techniques that do not employ a pre-pulse. For example, as shown in FIG. 17, a disk-shaped target 1720 that includes target material that emits light when converted to plasma is pre-formed and provided to a target region 1730 by releasing the disk target 1720 with a force that results in the disk target 1720 moving through the target region 1730 tilted relative to an amplified light beam 1710 that is received in the target region 1730.

FIGS. 7A and 7B show the vacuum chamber in the y-z plane and in two dimensions. However, it is contemplated that the profile 764 (FIG. 7B) may occupy three dimensions and may sweep out a volume in three dimensions. Similarly, FIGS. 9A, 9C, 10A, 10B, and 13A-13C show a vacuum chamber in the y-z plane and in two dimensions. However, it is contemplated that the targets in the vacuum chambers may tilt in any direction in three dimensions and the directional flux of particles and/or radiation may sweep out a space in three dimensions.

What is claimed is:

1. A method of providing targets to a target region of an extreme ultraviolet (EUV) light source, the method comprising:

providing a first target to a target region in an interior of a vacuum chamber, the first target comprising target material that emits extreme ultraviolet (EUV) light in a plasma state;

directing a first light beam toward the target region to form a first plasma from the target material of the first target, the first plasma being associated with a directional flux of particles and radiation emitted from the first target along a first emission direction, the first emission direction being determined by a position of the first target;

providing a second target to the target region in the interior of the vacuum chamber, the second target comprising target material that emits extreme ultraviolet light in a plasma state, wherein the first target and the second target are two targets in a stream targets;

distributing heat in the interior of the vacuum chamber relative to a separate and distinct object in the vacuum chamber by directing a second light beam toward the target region to form a second plasma from the target material of the second target, the second plasma being associated with a directional flux of particles and radiation emitted from the second target along a second emission direction, the second emission direction being determined by a position of the second target, the second emission direction being different from the first emission direction, wherein the separate and distinct object in the vacuum chamber is one of a plurality of targets in the stream other than the first target and the second target, and providing the one of the plurality of targets in the stream other than the first target to the target region in the interior of the vacuum chamber after distributing the heat such that the one of the plurality of targets follows a trajectory that is substantially the same as a trajectory followed by the first target and the second target.

2. The method of claim 1, wherein:

the target material of the first target is arranged in a first geometric distribution, the first geometric distribution having an extent along an axis oriented at a first angle relative to the separate and distinct object in the vacuum chamber, the target material of the second target is arranged in a second geometric distribution, the second geometric distribution having an extent along an axis oriented at a second angle relative to the separate and distinct object in the vacuum chamber, the second angle being different from the first angle, the first emission direction being determined by the position of the first target comprises the first emission direction being determined by the first angle, and the second emission direction being determined by the position of the second target comprises the second emission direction being determined by the second angle.

3. The method of claim 2, wherein:

providing a first target to an interior of a vacuum chamber comprises:

providing a first initial target to the interior of the vacuum chamber, the first initial target comprising target material in an initial geometric distribution; and directing an optical pulse toward the first initial target to form the first target, the geometric distribution of the first target being different from the geometric distribution of the first initial target, and providing a second target to an interior of a vacuum chamber comprises:

providing a second initial target to the interior of the vacuum chamber, the second initial target comprising target material in a second initial geometric distribution; and directing an optical pulse toward the second initial target to form the second target, the geometric distribution of the second target being different from the geometric distribution of the second initial target.

4. The method of claim 3, wherein the first initial target and the second initial target are substantially spherical, and the first target and the second target are disk shaped.

5. The method of claim 2, further comprising providing a fluid to the interior of the vacuum chamber, the fluid occupying a volume in the vacuum chamber, and wherein the separate and distinct object in the vacuum chamber further comprises a portion of the fluid.

6. The method of claim 5, wherein the fluid comprises a flowing gas.

7. The method of claim 1, wherein the first light beam comprises an axis, and the intensity of the first light beam is greatest at the axis of the first light beam;

the second light beam comprises an axis, and the intensity of the second beam is greatest at the axis of the second beam;

the first emission direction is determined by a location of the first target relative to the axis of the first light beam, and the second emission direction is determined by a location of the second target relative to the axis of the second light beam.

8. The method of claim 7, wherein the axis of the first light beam and the axis of the second light beam are along the same direction, the first target is at a location on a first side of the axis of the first light beam, and the second target is at a location on a second side of the axis of the first light beam.

9. The method of claim 7, wherein the axis of the first light beam and the axis of the second light beam are along different directions, and the first target and the second target are at substantially the same location in the vacuum chamber at different times.

10. The method of claim 7, wherein the first and second targets are substantially spherical.

11. A method of reducing the effect of plasma on an object in a vacuum chamber of an extreme ultraviolet (EUV) light source, the method comprising:

providing a stream of targets to the vacuum chamber, the stream of targets comprising a plurality of targets, the plurality of targets comprising an initial target and at least one other target;

modifying, in the vacuum chamber, the initial target to form a modified target, the initial target comprising target material in an initial geometric distribution and the modified target comprising target material in a different, modified geometric distribution; and directing a light beam toward the modified target, the light beam having an energy sufficient to convert at least some of the target material in the modified target to plasma that emits EUV light, the plasma being associated with a directionally dependent flux of particles and radiation, the directionally dependent flux having an angular distribution relative to the modified target, the angular distribution being dependent on a position of the modified target such that positioning the modified target in the vacuum chamber reduces the effect of the plasma on the object, wherein the object comprises one or more other targets in the stream of targets.

12. The method of claim 11, wherein the modified geometric distribution has a first extent in a first direction and a second extent in a second direction, the second extent being larger than the first extent, and further comprising positioning the modified target by orienting the second extent at an angle relative to the object.

13. The method of claim 12, wherein the at least one other target in the stream comprises a second initial target; and the method further comprises providing the second initial target to an interior of the vacuum chamber, the initial target and the second initial target traveling along a trajectory.

14. The method of claim 13, wherein the object is the second initial target.

15. The method of claim 14, wherein the second initial target is the target in the stream that is closest in distance to the initial target.

16. The method of claim 13, further comprising modifying the second initial target to form a second modified target, the second modified target having the modified geometric distribution of target material, and the second extent of the second modified target being positioned with the second extent oriented at a second, different angle relative to the object.

17. The method of claim 16, wherein the object further comprises one of more of a portion of a volume of fluid that flows in the vacuum chamber and an optical element in the vacuum chamber.

18. The method of claim 12, further comprising positioning the modified target by directing a pulse of light at the initial target away from a center of the initial target such that the target material of the initial target expands along the second extent and reduces along the first extent, and the second extent tilts relative to the object.

19. The method of claim 11, further comprising providing a fluid to the interior of the vacuum chamber, the fluid occupying a volume in the vacuum chamber, and wherein the object in the vacuum chamber further comprises a portion of the volume of the fluid.

20. A control system for an extreme ultraviolet (EUV) light source, the control system comprising:

one or more electronic processors;

an electronic storage storing instructions that, when executed, cause the one or more electronic processors to:

declare a presence of a first initial target at a first time, the first initial target having a distribution of target material that emits EUV light in a plasma state;

direct a first light beam toward the first initial target at a second time based on the declared presence of the first initial target, a difference between the first time and the second time being a first elapsed time;

declare a presence of a second initial target at a third time, the third time occurring after the first time, the second initial target comprising target material that emits EUV light in a plasma state; and direct the first light beam toward the second initial target at a fourth time based on the declared presence of the second initial target, the fourth time occurring after the second time, a difference between the third time and the fourth time being a second elapsed time, wherein the first elapsed time is different from the second elapsed time such that the first and second initial targets expand along different directions and have different orientations in a target region, the target region being a region that receives a second light beam having energy sufficient to convert target material to plasma that emits EUV light.

* * * * *